US008126378B2

(12) United States Patent
Uetake et al.

(10) Patent No.: US 8,126,378 B2
(45) Date of Patent: Feb. 28, 2012

(54) DEVELOPING DEVICE AND IMAGE FORMING APPARATUS WITH A TONER SEPARATION MEMBER THAT USES A BIAS VOLTAGE TO PULL AWAY TONER IN A DEVELOPER

(75) Inventors: Shigeo Uetake, Takatsuki (JP); Toshiya Natsuhara, Takarazuka (JP); Junya Hirayama, Takarazuka (JP); Takeshi Maeyama, Ikeda (JP); Makiko Watanabe, Uji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 310 days.

(21) Appl. No.: 12/387,580

(22) Filed: May 5, 2009

(65) Prior Publication Data

US 2009/0285597 A1 Nov. 19, 2009

(30) Foreign Application Priority Data

May 13, 2008 (JP) ..... 2008-125833
Sep. 26, 2008 (JP) ..... 2008-247605
Oct. 29, 2008 (JP) ..... 2008-278015

(51) Int. Cl.
*G03G 15/09* (2006.01)

(52) U.S. Cl. ..... 399/270

(58) Field of Classification Search ..... 399/53, 399/55, 258, 259, 265, 267, 269, 270, 284, 399/289

See application file for complete search history.

(56) References Cited

U.S. PATENT DOCUMENTS 4,572,631 A * 2/1986 Kondo ..... 399/272
5,832,350 A * 11/1998 Kumasaka et al. ..... 399/282
2004/0184843 A1* 9/2004 Sato ..... 399/283

FOREIGN PATENT DOCUMENTS

JP 59095554 A * 6/1984
JP 05-150636 6/1993
JP 10-319708 12/1998
JP 2005316016 A * 11/2005
JP 2007-034098 2/2007

* cited by examiner

*Primary Examiner* — David Gray
*Assistant Examiner* — Billy J Lactaoen
(74) *Attorney, Agent, or Firm* — Brinks, Hofer, Gilson & Lione

(57) ABSTRACT

Provided are a developing device and an image forming apparatus which employ a hybrid development method, have a toner-collecting developer supporting member and keep toner collecting ability stable for a long period of time to form high-quality images without development hysteresis (ghost) over a long period of time. A toner separation member abutting the toner-collecting developer supporting member through a toner-collecting developer layer is provided, and the toner separation member is applied with a bias voltage to form an electric field in such a direction as to pull toner away from the toner-collecting developer supporting member to prevent the toner from accumulating on the surface of the toner-collecting developer supporting member.

14 Claims, 16 Drawing Sheets

DEVELOPING DEVICE AND IMAGE FORMING APPARATUS WITH A TONER SEPARATION MEMBER THAT USES A BIAS VOLTAGE TO PULL AWAY TONER IN A DEVELOPER

This application is based on Japanese Patent Applications No. 2008-125833 filed on May 13, 2008, No. 2008-247605 filed on Sep. 26, 2008, No. 2008-278015 filed on Oct. 29, 2008, in Japanese Patent Office, the entire contents of which are hereby incorporated by reference.

TECHNICAL FIELD

The present invention relates to a hybrid developing device that uses a developer including a carrier and a toner and comprises: a toner-supplying developer supporting member for supplying toner to a toner supporting member; a toner supporting member for developing an electrostatic latent image with the supplied toner; and a toner-collecting developer supporting member for collecting post-development residual toner from the toner supporting member. The present invention also relates to an image forming apparatus equipped with this hybrid developing device.

BACKGROUND

Conventionally, the mono-component development method which uses only a toner as the developer and the dual component development method which uses a toner and a carrier have been known as development methods in image forming apparatuses using the electro-photography system.

The mono-component development method is advantageous in terms of simplicity, compactness, and low cost of the apparatus. However, toner deterioration can be accelerated by the strong stress on the regulating section that charges the toner, and the charge-accepting ability of the toner thereby can be to decrease. Furthermore, because the surfaces of the toner regulating member and of the toner-supporting member can be contaminated with the toner and external additives, the ability to charge toner can be reduced and the life-span of the developing device is accordingly shortened.

In the dual component development method, because toner is charged by triboelectric charging caused by being mixed with carrier, the stress is smaller and this is advantageous against toner deterioration. Furthermore, because the surface area of carrier is large, the carrier is relatively resistant to contamination of toner and external additives, and this is advantageous in extending the life-span.

However, in the dual-component development method, when the latent electrostatic image on the image supporting member is being developed, the surface of the image supporting member is rubbed with the magnetic brush of the developer, and thus a trace of a magnetic brush impressions can be generated. Furthermore, the carrier tends to attach to the image supporting member and thus causing a problem of image defects.

A hybrid developing method has been disclosed (Refer to Unexamined Japanese Patent Application Publication No. H 05-150636) to maintain a long life-span of the two component development, where development is performed with only toner which is supplied to the toner supporting member from a dual-component developer supported on the developer supporting member.

However, the hybrid development method is problematic in that the post-development residual toner, on the toner supporting member, that has not been used in development appears on the image as development hysteresis (ghost image) in the subsequent development process. This is caused by insufficient toner collecting capability of the developer supporting member stemming from applying a bias to the developer supporting member so as to put a priority on supplying the toner to the toner supporting member.

In recent years, in order to solve this problem i, a method has been proposed in which the toner-collecting developer supporting member to which a voltage for collecting the post-development residual toner is applied is added in the hybrid development method (Unexamined Japanese Patent Application Publication No. H 10-319708). In the method described in Unexamined Japanese Patent Application Publication No. H10-319708, the problem of development hysteresis does not occur in the beginning because the post-development residual toner on the toner supporting member is surely collected by the toner-collecting developer supporting member.

However, in this method, because a voltage is continuously applied to the toner-collecting developer supporting member to attract toner in the direction thereto, the toner collected from the toner supporting member or the toner separated from the carrier in the developer are transferred to the surface of the toner-collecting developer supporting member, and thereby causing uneven distribution.

In this state where the toner is unevenly (much) distributed on the surface of the toner-collecting developer supporting member, when the developer is removed from the toner-collecting developer supporting member, the unevenly toner is not removed and remains on the surface of the toner-collecting developer supporting member. As a result, a long time use causes toner to accumulate on the toner-collecting developer supporting member.

Further, when stored for a long time, the problem arises that the accumulated toner films the surface of the toner-collecting developer supporting member.

As another solution, in order to solve the problem of the ghost-image generation, a method has been proposed in which multiple toner-supplying developer supporting members are used in succession to supply a large amount of toner to the toner supporting member (Unexamined Japanese Patent Application Publication No. 2007-34098).

However, also in this method, collection of the post-development residual toner was insufficient, and the method cannot be considered appropriate as a measure for dealing with the problem of ghost images.

As described above, technological improvements have been carried out in order to deal with ghost-image generation in the hybrid development method, but no technology has been proposed to satisfactorily meet the requirement.

An object of the present invention is to solve the above problems and to provide a developing device and an image forming apparatus in which the hybrid development method with a toner-collecting developer supporting member is employed, the toner collection capability is maintained for a long time, and a high quality image without development hysteresis (ghost) is obtained for a long time.

SUMMARY

In view of forgoing, one embodiment according to one aspect of the present invention is a developing device, comprising:

a developer container for containing developer including toner and carrier;

a toner-supplying developer supporting member for supporting on a surface thereof the developer in the developer container to convey the developer;

a toner supporting member for supporting toner received from the toner-supplying developer supporting member and conveying the toner to develop an electrostatic latent image on an image supporting member;

a toner-collecting developer supporting member for being supplied with the developer from the toner-supplying developer supporting member and collecting a post-development residual toner from the toner supporting member into the developer;

a toner separation member which is configured to contact with the toner-collecting developer supporting member through the developer on the toner-collecting developer supporting member; and a power supply for applying a bias voltage which forms an electric field in such a direction as to pull away toner in the developer on the toner-collecting developer supporting member from the toner-collecting developer supporting member.

According to another aspect of the present invention, another embodiment is an image forming apparatus, comprising:

an image supporting member for supporting an electrostatic latent image thereon; and a developing device for developing the electrostatic latent image with toner, the developing device including:

a developer container for containing developer including toner and carrier;

a toner-supplying developer supporting member for supporting on a surface thereof the developer in the developer container to convey the developer;

a toner supporting member for supporting toner received from the toner-supplying developer supporting member and conveying the toner to develop an electrostatic latent image on an image supporting member;

a toner-collecting developer supporting member for being supplied with the developer from the toner-supplying developer supporting member and collecting a post-development residual toner from the toner supporting member into the developer;

a toner separation member which is configured to contact with the toner-collecting developer supporting member through the developer on the toner-collecting developer supporting member; and a power supply for applying a bias voltage which forms an electric field in such a direction as to pull away toner in the developer on the toner-collecting developer supporting member from the toner-collecting developer supporting member.

According to another aspect of the present invention, another embodiment is an image forming apparatus, comprising:

an image supporting member for supporting an electrostatic latent image thereon; and a developing device for developing the electrostatic latent image with toner, the developing device including:

a developer container for containing developer including toner and carrier;

a toner-supplying developer supporting member for supporting on a surface thereof the developer in the developer container to convey the developer;

a toner supporting member for supporting toner received from the toner-supplying developer supporting member and conveying the toner to develop an electrostatic latent image on an image supporting member;

a toner-collecting developer supporting member for being supplied with the developer from the toner-supplying developer supporting member and collecting a post-development residual toner from the toner supporting member into the developer;

a toner separation member which is configured to contact with the toner-collecting developer supporting member through the developer on the toner-collecting developer supporting member by a magnetic attraction force of a magnetic pole provided in the toner-collecting developer supporting member; and a power supply for applying a bias voltage which forms an electric field in such a direction as to pull away toner in the developer on the toner-collecting developer supporting member from the toner-collecting developer supporting member.

DETAILED DESCRIPTION OF THE PREFERRED EMBODIMENTS

The embodiments of the present invention will be described in the followings with reference to the drawings.

(Structure and Operation of the Image Forming Apparatus)

Figure 1:
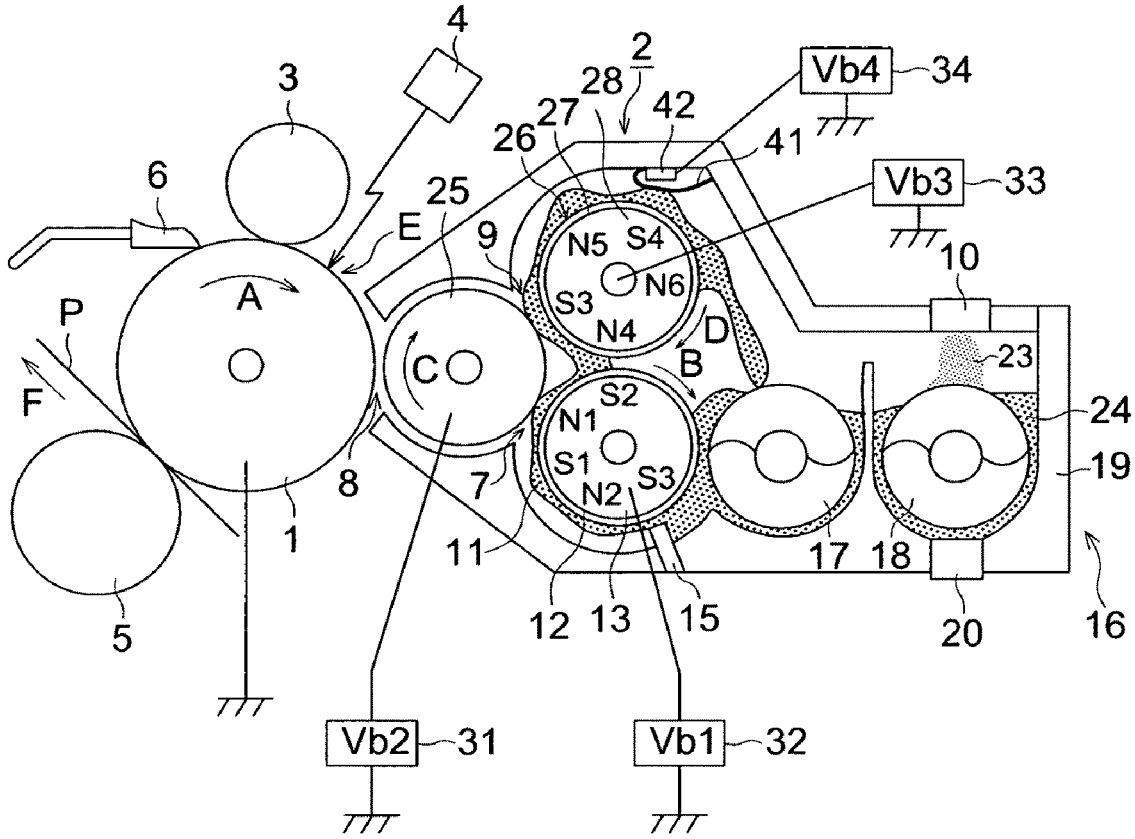
FIG. 1 is a cross-sectional view showing a structural example of the main part of a developing device 2 and an image forming apparatus provided with the developing device according to an embodiment of the present invention.

FIG. 1 shows an example of the structure of the main parts of an image forming apparatus according to the first embodiment of the present invention. The schematic structure and operation of the image forming apparatus will be described with reference to FIG. 1.

This image forming apparatus is a printer in which the toner image is formed on the image supporting member (photoreceptor) 1 by an electrophotographic method, and is transferred to a transfer medium P such as paper, and image formation is thus carried out.

This image forming apparatus includes an image supporting member 1 for supporting an image, and the following components are arranged around the image supporting member 1 in the rotational direction A thereof in this order: a charging member 3 for charging the image supporting member 1; a developing device 2*a* for developing electrostatic latent images on the image supporting member 1; a transfer roller 5 for transferring toner images on the image supporting member 1; and a cleaning blade 6 for cleaning residual toner on the image supporting member 1.

The image supporting member 1 is charged by the charging member 3, and then exposed at position E in the figure by an exposure device 4 which has a laser emitting device or the like, and an electrostatic latent image is formed on that surface. The developing device 2*a* develops this electrostatic latent image to forms a toner image. The transfer roller 5 transfers the toner image on the image supporting member 1 onto a transfer medium P and then discharges it in the direction of arrow F in the figure. The cleaning blade 6 removes the residual toner on the image supporting member 1 after transfer by a mechanical force.

Any known electrophotographic technology can be used for the image supporting member 1, the charging member 3, the exposure device 4, the transfer roller 5, the cleaning blade 6 and the like incorporated in the image forming apparatus. For example, a charging roller is employed as the charging member 3 in the figure, but it may be replaced by a charging device which does not come in contact with the image supporting member 1. Further, the cleaning blade may be omitted.

Next, an example of the structure of the developing device 2*a* of the hybrid development method according to the present embodiment will be described.

The developing device 2*a* includes the following components: a developer tank 16 for storing developer 24 which includes toner and carrier; a toner-supplying developer supporting member 11 which supports the developer 24 supplied from the developer tank 16 on its surface and then conveys the developer 24; a toner supporting member 25 which receives toner supplied from the toner-supplying developer supporting member 11 in a toner supply region 7 and develops an electrostatic latent image formed on the image supporting member 1; and a toner-collecting developer supporting member 26 which collects, in a toner collecting region 9, post-development residual toner remaining on the toner supporting member 25 after the toner passing through the developing region 8.

Further, a toner separation member (film member) is provided to attract the unevenly distributed toner on the surface of the toner-collecting developer supporting member just having passed through the toner collecting area 9, and pulls it away from the surface of the toner-collecting developer supporting member 26. This configuration allows the collected toner to be returned into the developer tank 16 together with the developer from which the toner is separated in the developer separation area, and thereby refreshing the toner layer on the toner supporting member.

The developing device 2 includes a toner-supporting-member biasing power supply 31 for supplying a development bias voltage Vb2 to the toner supporting member 25; a toner-supplying-developer-supporting-member biasing power supply 32 for supplying a toner supplying bias voltage Vb1 to the toner-supplying developer supporting member 11; a toner-collecting-developer-supporting-member biasing power. supply 33 for supplying a toner collecting bias voltage Vb3 to the toner-collecting developer supporting member 26; and a toner-separating bias power supply 34 for supplying a toner separating bias voltage Vb4 to the toner separation member 31.

The structure and operation of the developing device 2 will be described in detail in the followings.

(Developer Composition)

The composition of the developer used in the developing device of the embodiment will be described in the followings.

The developer 24 used in the embodiment includes a toner and a carrier for charging the toner.

<Toner>

There are no particular limitations imposed on the toner, and generally used known toners may be used. A toner may be used in which a binder resin is added with a colorant, and a charge control agent and a mold release agent if necessary, and is processed with an external additive. The toner particle diameter is preferably about from 3 to 15 μm, but is not limited thereto.

This type of toner may be manufactured by generally used known methods that are generally used. For example, the toner may be manufactured by methods such as pulverization, emulsion polymerization, and suspension polymerization.

Examples of the binder resin used in the toner include, but are not limited to styrene resins (homopolymer or copolymer including styrene or a styrene substitute), polyester resin, epoxy resin, vinyl chloride resin, phenol resin, polyethylene resin, polypropylene resin, polyurethane resin, silicone resin and the like. Depending on the individual resins and the combination of these resins, those having a softening temperature in the range of from 80 to 160° C. and a glass transition temperature in the range of from 50 to 75° C. are preferable.

As the colorant may be used a generally used known colorant, for example, carbon black, aniline black, activated carbon, magnetite, benzene yellow, permanent yellow, naphtol yellow, phthalocyanine blue, first sky blue, ultramarine blue, rose bengal, lake red and the like, and generally the amount used is preferably from 2 to 20% by mass of the binder resin.

As the charge control agent may be used any known charge control agent, and examples of the charge control agent for the positively charging toners include nigrosine dyes, quaternary ammonium chloride compounds, tri phenyl methane compounds, imidazole compounds, and polyamine resins. Examples of the charge control agent for negatively charging toners include azo dyes containing metals such as Cr, Co, Al, Fe, metal salicylate compounds, metal alkyl salicyclate compounds, calixarene, and the like. Generally the amount of the charge control agent used is preferably from 0.1 to 10% by mass of the binder resin.

As the release agent may be used any generally used known release agent, and one of or combination of the following agents can be used: polyethylene, polypropylene, carnauba wax, and Sasol wax. Generally, the release agent is preferably used by from 0.1 to 10% by mass of the binder resin.

As the external additive may be used any generally used known external additive such as fine inorganic particles including silica, titanium oxide, and aluminum oxide; and fine particles of resins including acrylic resin, styrene resin, silicone resin, and fluorine resin. In particular, external additives that have been hydrophobized using silane coupling agents, titanium coupling agents or silicone oil, are preferably used. These fluidity enhancers are added by from 0.1 to 5% by mass of the toner. The number average primary particle diameter of the external additive is preferably from 10 to 100 nm.

In addition, the external additive may be opposite polarity particles having the opposite polarity charge to that of the toner. The opposite polarity particles may be appropriately selected based on the toner charge polarity and be preferably used.

In the case where a negative polarity toner is used, fine particles that are to be positively charged are used as the opposite polarity particles, and examples include inorganic particles such as strontium titanate, barium titanate, alumina and the like; particles made of thermoplastic resins or thermosetting resins such as acrylic resin, benzoguamine resin, nylon (registered trademark) resin, polyimide resin, polyamide resin and the like. Also a positive charge control agent that provides positive charge may be included in a resin and it is also possible to form a copolymer with a nitrogen-containing monomer.

As the above-mentioned positive charge control agent, may be used, for example, nigrosine dye and quaternary ammonium salts and the like. AS the nitrogen-containing monomer, may be used 2-dimethyl amino ethyl acrylate, 2-diethyl amino ethyl acrylate, 2-dimethyl amino ethyl metacrylate, 2-diethyl amino ethyl metacrylate, vinylpyridine, N-vinylcarbazole, vinylimidazole and the like.

On the other hand, in the case where a positive polarity toner is used, as opposite polarity fine particles may be used fine inorganic particles such as silica, titanium oxide and the like as well as, fine particles formed from thermosetting resins or thermoplastic resins such as resins containing fluorine, polyolefin resins, silicone resins, polyester resins and the like. Also a negative charge control agent that provides a negative charge may be included in the resin or a copolymer with a fluorine based acrylic monomer or a fluorine based metacrylic monomer. Examples of the negative charge control agent that may be used include salicylic acid or naphtole chrome complexes, aluminum complexes, iron complexes, zinc complexes and the like.

In order to control the charge and hydrophobocity of the opposite polarity particles, the surface of the inorganic particles may be subjected to surface processing using a silane coupling agent, a titanium coupling agent, silicone oil and the like. In particular, in the case of providing a positive charge to the inorganic particles, the surface processing is preferably done using coupling agents having an amino radical, and in the case of providing a negative charge, the surface processing is preferably done using coupling agents having a fluorine radical.

The number average particle diameter of the opposite polarity particles is preferably from 100 to 1000 nm. The opposite polarity particles is added by from 1 to 10% by mass of the toner.

<Carrier>

No particular limitation is imposed on the carrier, and generally used known carriers may be used. A binder carrier or a coated carrier may be used. The particle diameter of the carrier is preferably from 15 to 100 μm but is not limited thereto.

The binder carrier is a carrier in which magnetic particles are dispersed in a binder resin, and charging fine particles of positive or negative polarity may be provided on the carrier surface and a surface coating layer may also be provided on the carrier. The charge properties such as polarity and the like of the binder carrier can be controlled by the binder resin material, the charging fine particles, and the type of surface coating layer.

Examples of the binder resin which is used as the binder type carrier include polystyrene resins such as vinyl resins; thermoplastic resins such as polyester resins, nylon resins, and polyolefin resins; and thermosetting resins such as phenol resins.

Examples of the magnetic particles for the binder carrier include spinel ferrites such as magnetite, gamma ferric oxide and the like; spinel ferrites including one or two non-ferrous metals (Mn, Ni, Mg, Cu and the like); magnetic plumbite ferrites such as barium ferrite; and particles of iron or alloys having an oxide layer on the surface. The shape of these particles may be spherical or needle-shaped. In the case where high magnetism is required, iron based ferromagnetic particles are preferably used. In terms of chemical stability, ferromagnetic particles such as spinel ferrites including magnetite and gamma ferric oxide; magnetic plumbite ferrites such as barium ferrite may be used. By suitably selecting the type and the amount of the ferromagnetic particles, a magnetic resin carrier having the desired magnetization can be obtained. The magnetic particles should be added to the magnetic resin carrier by from 50 to 90% by mass.

As the surface coating material for the binder carrier, may be used Silicone resin, acrylic resin, epoxy resin, fluorine resins and the like, and the charge providing ability is improved by coating these resins on the surface of the binder carrier and hardening the coated layer.

Fixing the charging fine particles or the conductive fine particles to the surface of the binder carrier may be carried out, for example, by uniformly mixing the magnetic resin carrier and the fine particles to attach the fine particles to the surface of the magnetic resin carrier and then applying a mechanical or thermal impact to them to drive and fix the fine particles in the magnetic carrier. In this case, the fine particles are not completely buried in the magnetic resin carrier, but rather fixed with a portion thereof protruded from the surface of the magnetic resin carrier.

As the charging fine particles, organic and inorganic insulating materials may be used. The following examples of the organic insulating particles may be specifically used: polystyrene, styrene copolymers, acrylic resins, various acrylic copolymers, nylon, polyethylene, polypropylene, fluorine resins and bridged compounds thereof. The desired level of charge and polarity can be obtained by appropriately selecting the material, polymerization catalyst, surface processing and the like. The following examples of the inorganic particles may be used: silica and titanium dioxide as negatively charging particles, and strontium titanate and alumina as negatively charging particles.

On the other hand, the coated carrier is a carrier in which a carrier core particle formed of magnetic materials are coated with resins, and as in the case of the binder carrier, positively or negatively charging particles also can be fixed to the carrier surface. Charging properties of the coating resin such as polarity and the like can be controlled depending on the type of the surface coating layer and the charged particles, and the same materials as in the case of the binder carrier may be used. In particular, the coating resin can be the same resins as those used for the binder resin of the binder carrier.

The mixing ratio of the toner to the carrier may be adjusted in order to obtain the desired toner charge amount, and the mixing ratio of toner to the total amount of the toner and the carrier from 3 to 50% by mass is appropriate, and the ratio from 6 to 30% is more appropriate.

(Structure and Operation of the Developing Device 2)

A detailed example of the structure and operation of the developing device 2 according to the embodiment will be described with reference to FIG. 1.

<Structure of Device>

As described above, the developer 24 used in the developing device 2 is formed of a toner and a carrier and is stored in the developer tank 16.

The developer tank 16 is formed of a casing 19, and mixing/stirring members 17 and 18 are normally stored inside. The mixing/stirring members 17 and 18 stir and mix the developer 24 and supply the developer 24 to the toner-supplying developer supporting member 11. An ATDC (Automatic Toner Density Control) sensor 20 is preferably provided at the position opposing the mixing/stirring member 18 in the casing 19.

The developing device 2 is usually equipped with a replenishing section 10 for replenishing the developer tank 16 with toner of the amount consumed in the development region 8. The replenishing section 10 supplies the developer tank 16 with the replenishing toner 23 fed from the hopper (not shown) storing the replenishing toner 23.

The developing device 2 also has a control member (control blade) 15 for making the developer layer thin and controlling the amount of the developer on the toner-supplying developer supporting member 11.

The toner-supplying developer supporting member 11 includes a fixed magnetic body 13 and a rotatable sleeve roller 12 which encircles the fixed magnetic roller 13, and at the time of image formation a toner supply bias Vb1 for supplying toner to the toner supporting member 25 is applied by the toner-supplying developer supporting member biasing power supply 32.

The magnetic body 13 has five magnetic poles S1, N1, S2, S3, and N2, along the direction B of rotation of the sleeve roller 12. Of these magnetic poles, the primary magnetic pole N1 is arranged at the position corresponding to the toner supply region 7 which opposes the toner supporting member 25.

Similarly, the toner-collecting developer supporting member 26 includes a fixed magnetic roller 28 and a rotatable sleeve roller 27 which encircles the fixed magnetic roller 28, and is applied, by the toner-collecting developer supporting member biasing power supply 33, with a toner collection bias for collecting the post-development residual toner on the toner supporting member 25.

The magnetic roller 28 has 5 magnetic poles N4, S3, N5, S4, and N6 along the direction of rotation of the sleeve roller 27. Of these magnetic poles, the primary magnetic pole S3 is arranged at the position corresponding to the toner collecting region 8 which opposes the toner supporting member 25.

The homopolar sections N6 and N4 which generate repelling magnetic fields for stripping the developer 24 on the surface of the sleeve roller 27 are arranged facing the inside of the developer tank 16.

Between the toner collecting area 9 of the toner-collecting developer supporting member 26 and the developer separation area (above-mentioned homopolar sections) is provided a toner separation member (film member) 41 for attracting the toner unevenly distributed on the surface of the toner-collecting developer supporting member having passed through the toner collection area 9, and the it is applied with the toner separation bias Vb4 through a supporting electrode 42.

Furthermore, in the developing device 2, the S2 pole and N4 pole are arranged opposing each other in the toner-supplying developer supporting member 11 and the toner-collecting developer supporting member 26 respectively, in order to transfer the developer 24 on the surface of the toner-supplying developer supporting member 11 to the toner-collecting developer supporting member 26. The developer 24 is transferred from the S2 magnetic pole side of the toner-supplying developer supporting member 11 to the N4 magnetic pole side of the toner-collecting developer supporting member 26 and then conveyed.

The toner supporting member 25 is arranged opposing the toner-supplying developer supporting member 11, the toner-collecting developer supporting member 26, and the image supporting member 1, and a development bias Vb2 for developing the electrostatic latent image on the image supporting member 1 is applied by the toner-supporting member biasing power supply 31.

The toner supporting member 25 may be formed of any material provided that the abovementioned voltage can be applied, and an example is an aluminum roller with its surface having been subjected to surface processing such as alumite treatment or the like. In addition, the toner supporting member 25 may be formed of a conductive substrate such as aluminum with the following coatings: resin coating such as a coating of polyester resin, polycarbonate resin, acrylic resin, polyethylene resin, polypropylene resin, urethane resin, polyamide resin, polyimide resin, polysufone resin, polyethyl ketone resin, vinyl chloride resin, vinyl acetate resin, silicone resin, and fluorine resin; or a rubber coating of silicone rubber, urethane rubber, nitryl rubber, natural rubber, isoprene rubber and the like.

A conducting agent may be added to the bulk or to the surface of the aforementioned coating. The conducting agent may be an electron conductive agent or an ion conductive agent. Examples of the electron conductive agent include, without being limited thereto, carbon blacks such as Ketzin black, acetylene black, furnace black; and metal powders and metal oxide particles. Examples of the ion conducting agent include, without being limited thereto, cationic compounds such as quaternary ammonium chloride; amphoteric compounds; and other ionic polymer materials. Furthermore, a conductive roller formed from a metal material such as aluminum or the like may be used.

<Operation of the Device>

An example of the operation of the developing device 2 will be described in detail with reference to FIG. 1.

The developer 24 inside the development tank 16 is stirred and mixed and circulatingly conveyed in the developer tank 16 by the rotation of the mixing/stirring members 17 and 18 while triboelectric charging is done. The developer 24 is supplied to the sleeve roller 12 of the toner-supplying developer supporting member 11.

The developer 24 is held on the surface of the sleeve roller 12 by the magnetic force of the magnetic body 13 inside the toner-supplying developer supporting member 11 and rotatingly moves along with the sleeve roller 12, and its passing amount is regulated by the regulation member 15 provided opposing the toner-supplying developer supporting member 11.

Subsequently, the developer 24 is conveyed to the toner supply region 7 where the toner-supplying developer supporting member 11 opposes the toner supporting member 25.

The bristle of developer is formed by the magnetic force of the primary magnetic pole N1 of the magnetic body 13 in the toner supply region 7, and the supplying electric field generated by the development bias Vb2 applied to the toner supporting member 25 and the toner supply bias Vb1 applied to the toner-supplying developer supporting member 11 causes the toner in the developer 24 to be transferred to the toner supporting member 25 side.

The toner layer transferred to the toner supporting member 25 by this toner-supplying electric field is conveyed to the developing region 8 by the rotation of the toner supporting member 25, is transferred, assisted by a development field formed by the development bias and the potential of the latent image, onto the image supporting member 1, and the latent image is thus developed to be a visible image.

The toner layer on the toner supporting member 25 from which the toner has been consumed (post-development residual toner) in the development region 8, is further conveyed, by the rotation of the toner supporting member 25, to the toner collection area 9 where the toner supporting member 25 opposes the toner-collecting developer supporting member 26.

Meanwhile, the developer 24 from which toner has been supplied to the toner supporting member 25 in the toner supply region 7 is conveyed to the region opposing the toner-collecting developer supporting member 26, and then transferred to the toner-collecting developer supporting member 26 by the magnetic field formed by the magnetic pole S2 of the toner-supplying developer supporting member 11 and the magnetic pole N4 of the toner-collecting developer supporting member 26.

The developer 24 transferred to the toner-collecting developer supporting member 26 rotates along with the sleeve roller 27 of the toner-collecting developer supporting member 26 and is conveyed to the toner collection area 9 where the toner-collecting developer supporting member 26 opposes the toner supporting member 25.

In the toner collection area 9, the post-development residual toner is moved from the toner supporting member 25 to the toner-collecting developer supporting member 26 and collected by the electrostatic force applied to the toner and the mechanical frictional force, where the electrostatic force is generated by the development bias Vb2 applied to the toner supporting member and the toner collection bias Vb3 applied to the toner-colleting developer supporting member 26, and the mechanical frictional force is caused by the developer 24 held on the toner-collecting developer supporting member 26.

The toner collected on the toner-collecting developer supporting member 26 is unevenly distributed, by the action of the collection electric field in the toner collection area 9, in a vicinity of the surface of the toner-collecting developer supporting member in the layer of the toner 24 supported on the toner-collecting developer supporting member 26 (forming a toner layer on the surface of the toner-collecting developer supporting member 26).

However, the uneven distribution of the toner is eliminated by the force applied to the toner, on the way of the toner 24 to the developer tank 16, in the contact area where the developer is in contact with the toner separation member (film member), where the force is generated by the toner collection bias Vb3 applied to the toner-collecting developer supporting member 26 and the toner separation bias Vb4 applied to the film member 41. There will be described latter the uneven distribution of toner and elimination thereof by the toner separation member and the contact of the toner separation member with the developer layer.

The developer 24 including the corrected toner on the toner-collecting developer supporting member 26 is conveyed in the direction to the developer tank 16 with the rotation of the sleeve 27 and is stripped from the toner-collecting developer supporting member 26 by the repelling magnetic field of the homopolar section N6 and N4 of the magnetic body 28 and then collected into the developer tank 16.

Based on the output signal from the ATDC sensor 20, when the replenishment control section (not shown) detects that the toner density in the developer 24 is less than the minimum toner density needed for attaining image density, the replenishing toner 23 stored in the hopper is supplied by a toner replenishing means (not shown) into the development tank 16 through the toner replenishing section 10.

<Flow of the Developer>

It is to be noted that the flow of the developer in this example of the structure and operation of the developing device 2 is as follows.

The toner-supplying developer supporting member 11 and the toner-collecting developer supporting member 26 are arranged opposing each other, and the developer 24 is supplied from the development tank 16 onto the toner-supplying developer supporting member 11, after being regulated on the toner-supplying developer supporting member 11, is transferred from the toner-supplying developer supporting member 11 onto the toner-collecting developer supporting member 26, and then is separated from the toner-collecting developer supporting member 26 to be returned to the developer tank 16.

It is to be noted, however, that the flow of the developer 24 is not limited to the flow described above.

For example, the developer 24 may be transferred back from the toner-collecting developer supporting member 26 onto the toner-supplying developer supporting member 11 and be returned from the toner-supplying developer supporting member 11 into the developer tank 16. In this case, the toner separation member (film member) 41 may be disposed in the downstream of the toner collection area 9 and before the transfer of the developer.

In addition, the developer 24 may be supplied to the toner-supplying developer supporting member 11 and the toner-collecting developer supporting member 26 from the developer tank 16, and may be conveyed, after each amount being regulated, to the toner supply region 7 and the toner collection region 9 respectively, then may be separated from the respective developer supporting members and returned to the developer tank 16. (The flows of the developer on the toner-supplying developer supporting member 11 and the toner-collecting developer supporting member 26 are independent of each other).

That is to say, no particular limitation is imposed on the flow provided that the toner density of the developer 24 conveyed to the toner supply region 7 is adjusted in the developer tank 16.

(A Problem in a Toner Collection Area, and a Toner Separation Member)

A problem regarding toner collecting ability in a toner collection area (toner accumulation on a toner-collecting developer supporting member), and a toner separation member for preventing the problem are discussed in detail.

First, development hysteresis (ghost) is described, followed by discussions on toner supply by a developer supporting member, toner collecting ability, and bias setting, and finally, toner accumulation on a toner-collecting developer supporting member, and setting of the toner separation member to prevent the loss of the collecting ability caused by the toner accumulation are described.

<Ghost>

Figure 2A:
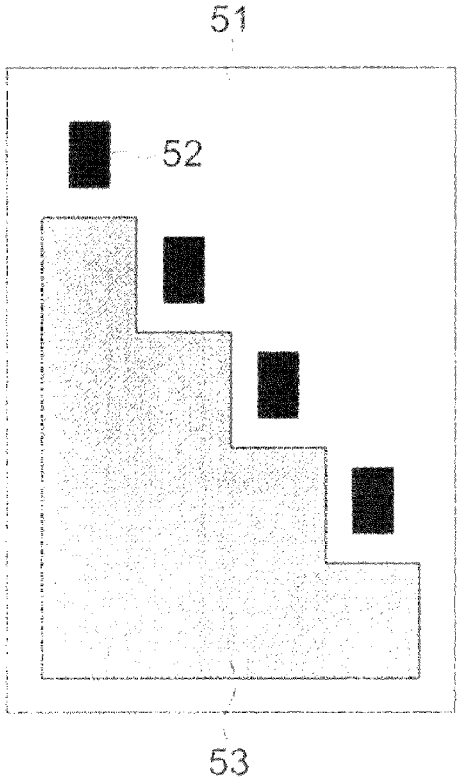
FIG. 2*a* shows a chart for evaluating development hysteresis.
Figure 2B:
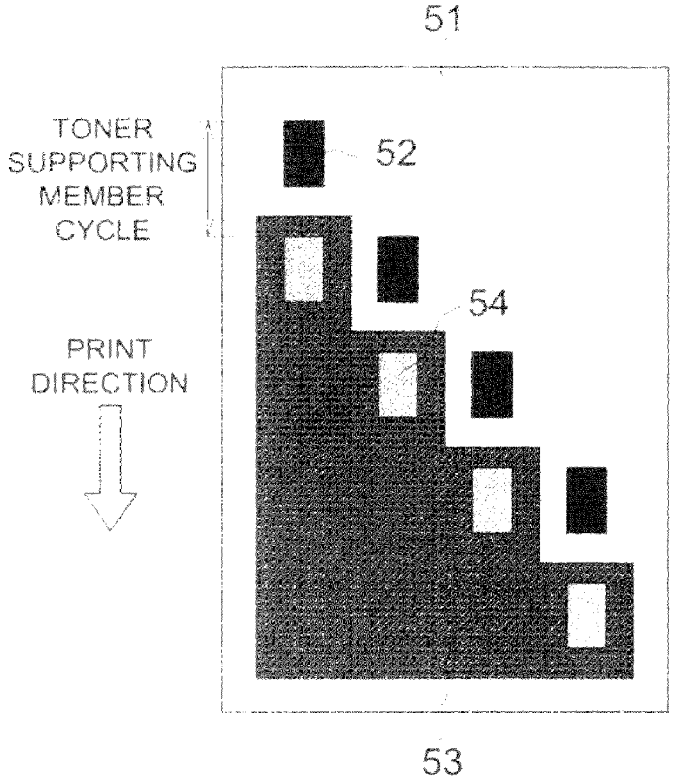
FIG. 2*b* shows an example of ghost-image occurrence when printing.

Development hysteresis (also referred to as ghost or image memory) is explained using FIGS. 2*a* and 2*b*.

FIG. 2*a* is an example of an image chart used for detecting a ghost image. On a white background area 51, a solid black area 52 and a halftone image area 53 are arranged as shown in the figure. FIG. 2*b* is an example of a printed image showing ghost-image occurrence after the image chart in FIG. 2*a* was printed in the direction shown in the chart.

The development hysteresis (image memory or ghost) is the following phenomenon.

Supposing that a gray scale chart which has a high contrast image such as a solid black area 52 on a white background 51 and a successive halftone area 53 such as gray as shown in FIG. 2*a* is printed. Then, in the output print image, a pattern similar to the high contrast image printed upstream, which was not present in the original image chart, appears in the halftone image area 53 as shown in FIG. 2*b*. In FIG. 2*b*, a ghost pattern 54 can be seen in the halftone image area 53, at the position one cycle of a toner supporting member after the solid black area.

Such a phenomenon is caused by the following.

Immediately after printing a high contrast image, a layer of post-development residual toner corresponding to the printed image pattern remains on the toner supporting member. Thus, if the residual is not sufficiently removed, thickness irregularities corresponding to the printed image pattern will result in the toner layer on the toner supporting member even after toner is supplied to the toner supporting member in the subsequent stage.

These thickness irregularities in the toner layer changes the development characteristics, and causes density irregularities (ghost) corresponding to the preceding printed pattern to appear on the following print image. These density irregularities caused by the change in the development characteristics are mostly visible in a halftone image.

Therefore, sufficient collection of the post-development residual toner on the toner supporting member is necessary to prevent the occurrence of ghost.

<Toner Supply by Each of the Developer Supporting Members, Toner Collecting Ability, and Bias Setting>

The present embodiment employs a hybrid development method. In particular, it employs a hybrid development method of a toner supply/collection function separation type, in which not only a toner-supplying developer supporting member for supplying toner to a toner supporting member but also a toner-collecting developer supporting member to which voltage is applied to collect post-development residual toner on the toner supporting member are provided.

Taking a developing device without a toner separation member as an example, toner supply by the toner-supplying developer supporting member and the toner-collecting developer supporting member, toner collecting ability, and bias setting are explained with reference to FIGS. 3*a*, 3*b*, and 3*c*.

Figure 3A:
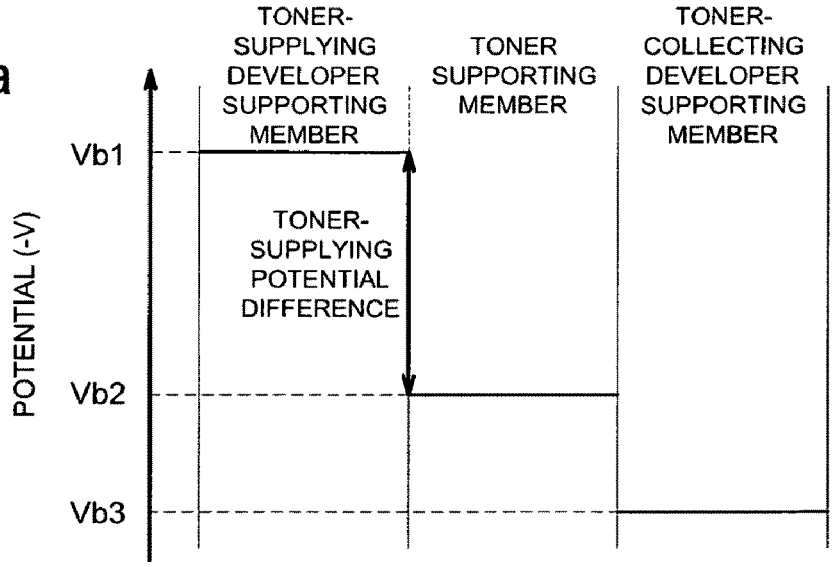
FIGS. 3*a*, 3*b*, and 3*c* show a relationship between a bias voltage applied to each a toner-supplying developer supporting member, a toner supporting member, and a toner-collecting developer supporting member, and a toner layer potential affected by toner accumulation.
Figure 3B:
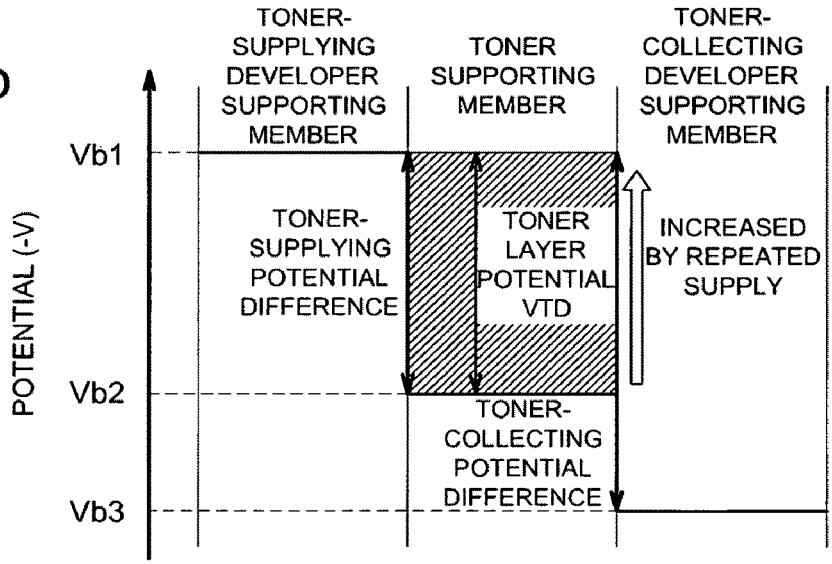
Figure 3C:
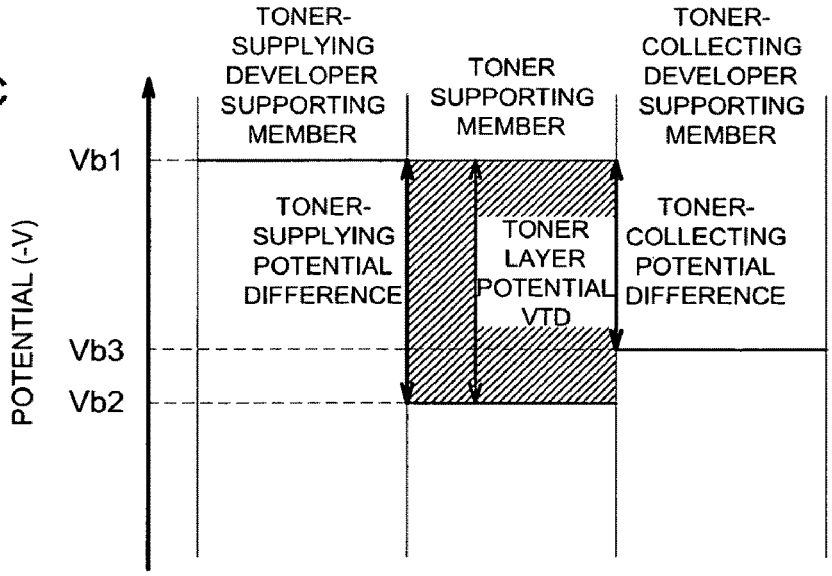

FIGS. 3*a*, 3*b*, and 3*c* show a bias voltage applied to each a toner-supplying developer supporting member 11, a toner supporting member 25, and a toner-collecting developer supporting member 26, and a toner layer potential affected by toner accumulation in the device without a toner separation member, supposing that negative charging toner is used.

The bias voltage applied to each the toner-supplying developer supporting member 11, the toner supporting member 25, and the toner-collecting developer supporting member 26 may be DC voltage or AC-superimposed DC voltage. Here, for simplicity, the average value of each applied voltage is used for discussion. Note that the average value of the applied voltage means a voltage value for DC bias voltage, and a DC component value for AC-superimposed bias voltage. For example, it will be the time average for an asymmetrical wave such as a rectangular wave with a duty ratio (the same applies to the rest).

FIG. 3*a* shows an example of a relationship between bias voltages Vb1, Vb2, and Vb3 applied to the toner-supplying developer supporting member 11, the toner supporting member 25, and the toner-collecting developer supporting member 26, respectively.

In this example, a potential difference Vb2−Vb1 (a toner-supplying potential difference) is applied between the toner-supplying developer supporting member 11 and the toner supporting member 25 to supply toner from the developer on the toner-supplying developer supporting member 11 to the toner supporting member 25.

In addition, in order to collect the unused toner for development (post-development residual toner) remaining on the toner supporting member 25 onto the toner-collecting developer supporting member 26, a potential difference Vb3−Vb2 (a toner-collecting potential difference) is applied between the toner supporting member 25 and the toner-collecting developer supporting member 26.

First of all, the toner supply from the toner-supplying developer supporting member 11 to the toner supporting member 25 is discussed.

The amount of toner supply from the toner-supplying developer supporting member 11 to the toner supporting member 25 depends on a value of the toner-supplying potential difference Vb2−Vb1. The amount of toner have been supplied gradually increases as toner is repeatedly supplied until, and the maximum amount have been supplied generates a potential approximately equal to the toner-supplying potential difference Vb2−Vb1 (see FIG. 3*b*).

In this way, the amount of toner on the toner supporting member 25 varies depending on toner supply hysteresis (the amount of toner on the toner supporting member 25 before toner supply, or development hysteresis). Because of this, if no toner-collecting developer supporting member 26 is provided, it is difficult to maintain a constant toner amount on the toner supporting member 25. Depending on the development hysteresis, unevenness in the toner amount on the toner supporting member 25 is likely to occur, and cause image memory (ghost).

Thus, the toner-collecting developer supporting member 26 is provided to keep the evenness in the toner amount on the toner supporting member 25 before toner supply, regardless of the development hysteresis, by collecting at least a part of the post-development residual toner.

As a result, the collection of the post-development residual toner on the toner supporting member 25 onto the toner-collecting developer supporting member 26 is affected by not only a potential difference Vb3−Vb2 (a toner-collecting potential difference) between the toner supporting member 25 and the toner-collecting developer supporting member 26, but also the toner layer potential Vtd on the toner supporting member 25.

In other words, the effective toner-collecting potential difference is the potential difference Vb3−(Vb2+Vtd) which is the potential difference between the sum of the voltage Vb2 applied to the toner supporting member 25 and the toner layer potential Vtd (Vb2+Vtd) and the voltage Vb3 applied to the toner-collecting developer supporting member 26.

Therefore, if the voltage Vb3 applied to the toner-collecting developer supporting member 26 makes Vb2+Vtd−Vb3 to be a voltage to make an electric field in such a direction to collect toner, toner collection is achieved by an electrostatic force.

For example, as shown in FIG. 3*c*, even when the applied voltage Vb3 applied to the toner-collecting developer supporting member 26 is in the toner-supplying direction from the applied voltage Vb2 applied to the toner supporting member 25, the effective toner-collecting potential difference is still effective to a part of the toner layer in the collecting direction, so that the development hysteresis (toner amount irregularities) on the toner supporting member 25 can be leveled before toner supply.

As described above, the collection of the post-development residual toner from the toner supporting member 25 onto the toner-collecting developer supporting member 26 in a toner collection area 9 depends on the effective toner potential difference. However, when the electric field in the collecting direction is too strong in the toner collection area 9, the following problem may occur.

That is, the toner collected from the toner supporting member 25 in the toner collection area 9 and the toner separated from carrier contained in the developer (bristle) move toward the surface of the toner-collecting developer supporting member 26 and cause uneven distribution of toner on the surface area.

<Toner Accumulation on the Toner-Collecting Developer Supporting Member, and Deterioration of Toner Collection Ability>

Figure 4A:
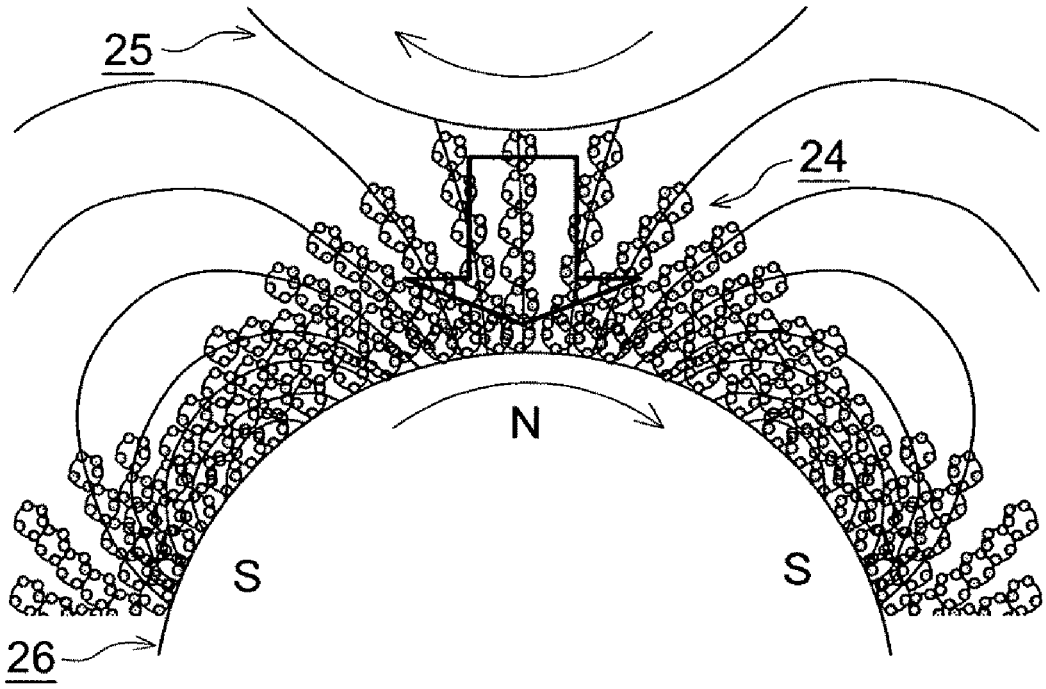
FIGS. 4*a*, 4*b*, and 4*c* are cross-sectional views showing an appearance of the bristle of the developer by the effect of a magnetic pole in the toner-collecting developer supporting member, and toner movement in the direction of the electric field in a toner collection area 9.
Figure 4B:
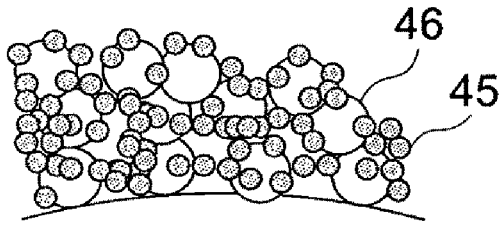
Figure 4C:
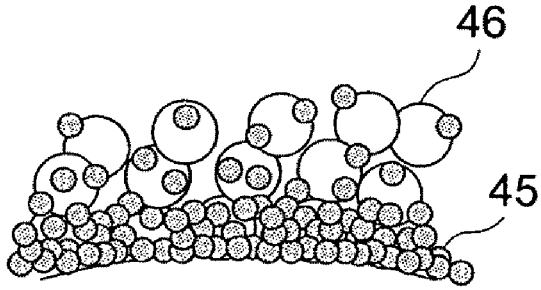

FIGS. 4*a*, 4*b*, and 4*c* are cross-sectional views showing an appearance of bristle caused by the effect of the magnetic poles in the toner-collecting developer supporting member 26, and toner movement in the direction of the electric field in the toner collection area 9. Uneven distribution and accumulation of toner on the toner-collecting developer supporting member 26 and the deterioration in collection ability caused thereby are described using FIGS. 4*a*, 4*b*, and 4*c*.

In FIG. 4*a*, the bristle of the developer 24 (like a magnetic brush) is almost parallel to the direction of the collecting electric field (see the large arrow in the center of the figure). A part of the toner collected onto the toner-collecting developer supporting member 26 and the toner contained in the developer 24 on the toner-collecting developer supporting member 26 easily move, by the effect of the toner-collecting electric field, to the surface of the toner-collecting developer supporting member 26 along the magnetic brush formed by the effect of the magnetic poles.

As a result, while toner 45 is evenly distributed being attached to the surface of the carriers particles 46 at the upstream of the toner collection area 9 as shown in FIG. 4*b*, some of the toner 45 is separated from the carriers 46 at the downstream after passing through the toner collection area 9, and it form a toner layer or uneven distribution on the toner-collecting developer supporting member 26 as shown in FIG. 4*c*.

As described above, the unevenly distributed toner having been moved to the surface of the toner-collecting developer supporting member 26 is separated from the carriers. Because of this, after the developer 24 is transported by rotation of the toner-collecting developer supporting member 26 and when it is returned to a developer tank 16 by magnetic repulsion between homopolar N6 and N4 in a magnet roll 28, the toner does not return to the developer tank 16 together with the carrier, but some remains on the surface of the toner-collecting developer supporting member 26.

The amount of this residual toner on the surface of the toner-collecting developer supporting member 26 gradually increases, and the toner accumulates as the collecting operation repeats. When supplying and collecting potentials are set as shown in FIG. 3*a*, the toner layer potential Vtr on the toner-collecting developer supporting member 26 eventually increase up to approximately the same level as the sum of the applied voltage Vb2 of the toner supporting member 25 and the toner layer potential Vtd on the toner supporting member 25 as shown in FIG. 5.

The increase in the toner layer potential Vtr by accumulation of charged toner on the toner-collecting developer supporting member 26 means a decrease in the effective collecting potential difference Vb3+Vtr−(Vb2+Vtd) for the toner-collecting developer supporting member 26 to collect toner.

Figure 5:
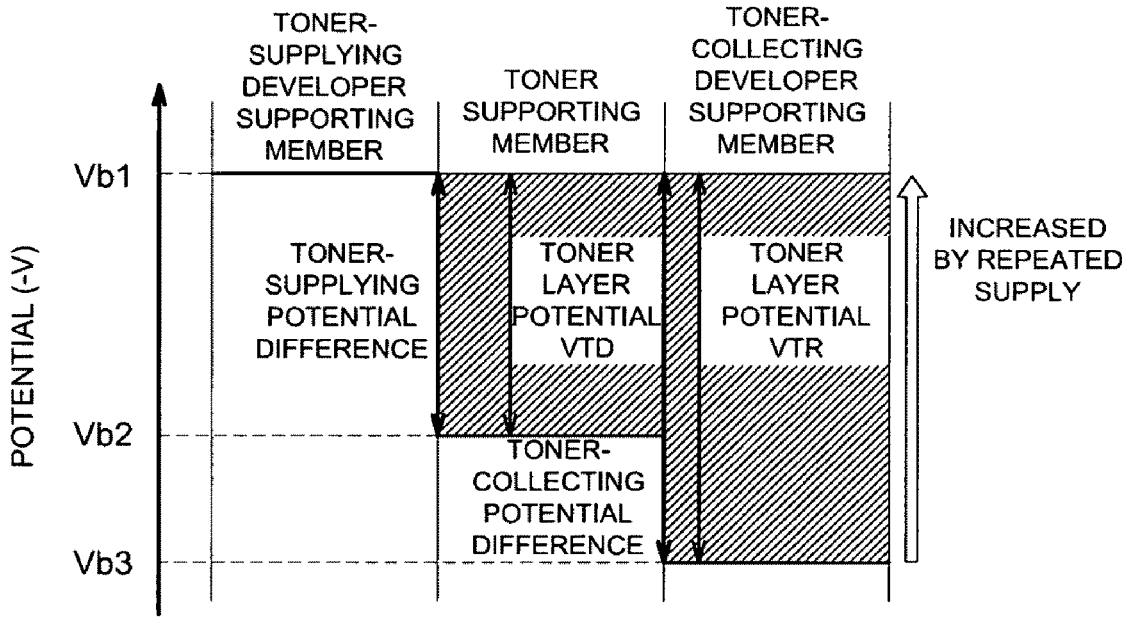
FIG. 5 shows a relationship between bias a voltage applied to each the toner-supplying developer supporting member, the toner supporting member, and the toner-collecting developer supporting member, and the toner layer potential affected by the toner accumulation, when the toner is accumulated.

In particular, if the toner layer potential Vtr on the toner-collecting developer supporting member 26 is increased to the level shown in FIG. 5, the effective potential difference for collection is zero.

Thus, the accumulation of charged toner on the surface of the toner-collecting developer supporting member 26 disturbs the collecting electric field in the toner collection area 9 and reduces toner collection ability. For this reason, the ability to collect post-development residual toner, which has been good until the toner accumulation, cannot be maintained very long, and a problem of ghost starts to occur as image formation is repeated.

In the present embodiment, a toner separation member is provided to solve the problem of unevenly distributed toner on the toner-collecting developer supporting member 26 caused in the toner collection area, and to control the deterioration of toner collection ability caused by the above-described toner accumulation. The effects are described below.

<Functional Operation of the Toner Separation Member>

FIGS. 6*a*, 6*b*, 7*a*, and 7*b* show applied voltages to the toner-supplying developer supporting member 11, the toner supporting member 25, the toner-collecting developer supporting member 26, and the toner separation member (film member) 41, and toner layer potentials caused by the toner having been moved by each potential difference, in the device in which the toner separation member (film member) 41 according to the present invention is provided, where negatively-charged toner is used in the same manner as in FIGS. 3*a*, 3*b*, and 3*c*.

In FIGS. 6*a*, 6*b*, 7*a*, and 7*b*, as well as in FIGS. 3*a*, 3*b*, and 3*c*, the voltage applied to each the toner-supplying developer supporting member 11, the toner supporting member 25, the toner-collecting developer supporting member 26, and the toner separation member (film member) 41 may be DC voltage or AC-superimposed DC voltage. Here, for simplicity, the average value of each applied voltage is used for discussion.

Figure 6A:
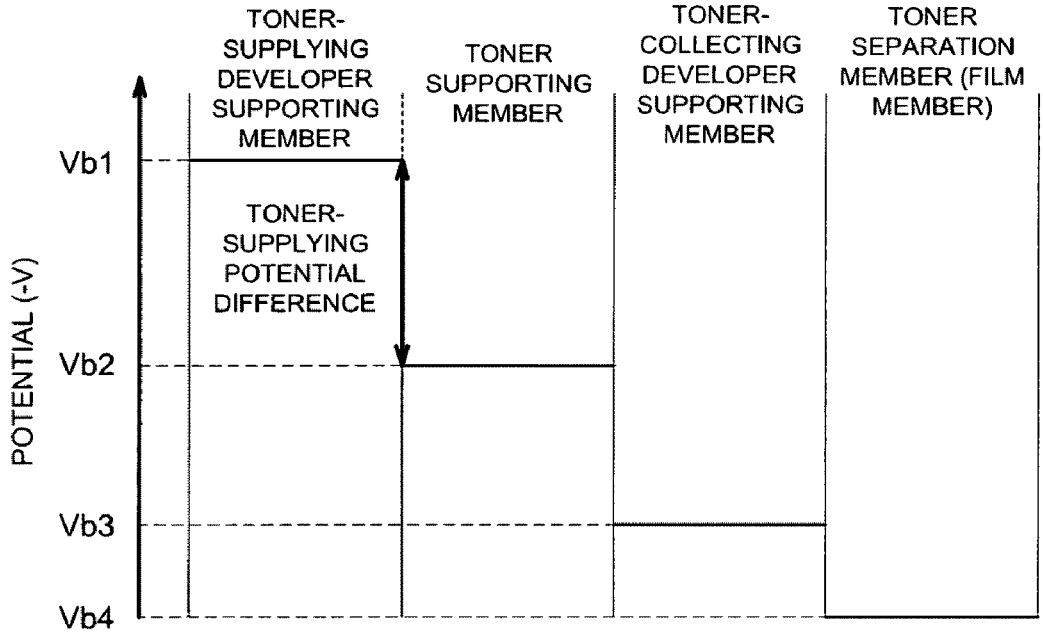
FIGS. 6*a* and 6*b* show a relationship 1 between the bias voltage and the toner layer potential when a toner separation member (film member) 41 is provided.

FIG. 6*a* shows an example of a relationship among voltages Vb1, Vb2, Vb3, and Vb4 applied to the toner-supplying developer supporting member 11, the toner supporting member 25, the toner-collecting developer supporting member 26, and the toner separation member (film member) 41 respectively.

In this example also, the toner-supplying potential difference Vb2−Vb1 is set so as to supply toner from the developer on the toner-supplying developer supporting member 11 to the toner supporting member 25. The toner-collecting potential difference Vb3−Vb2 is also set to as to collect the toner not used for development (post-development residual toner)

remaining on the toner supporting member 25 onto the toner-collecting developer supporting member 26.

In addition, a toner separating potential difference Vb4–Vb3 is applied between the toner-collecting developer supporting member 26 and the toner separation member (film member) 41 to attract the toner layer unevenly distributed on the toner-collecting developer supporting member toward the toner separation member (film member) 41.

With regard to the toner supply from the toner-supplying developer supporting member 11 to the toner supporting member 25 and the toner collection of the post-development residual toner on the toner supporting member 25 onto the toner-collecting developer supporting member 26, discussion is omitted since they are the same as in FIGS. 3*a*, 3*b*, and 3*c*.

Figure 6B:
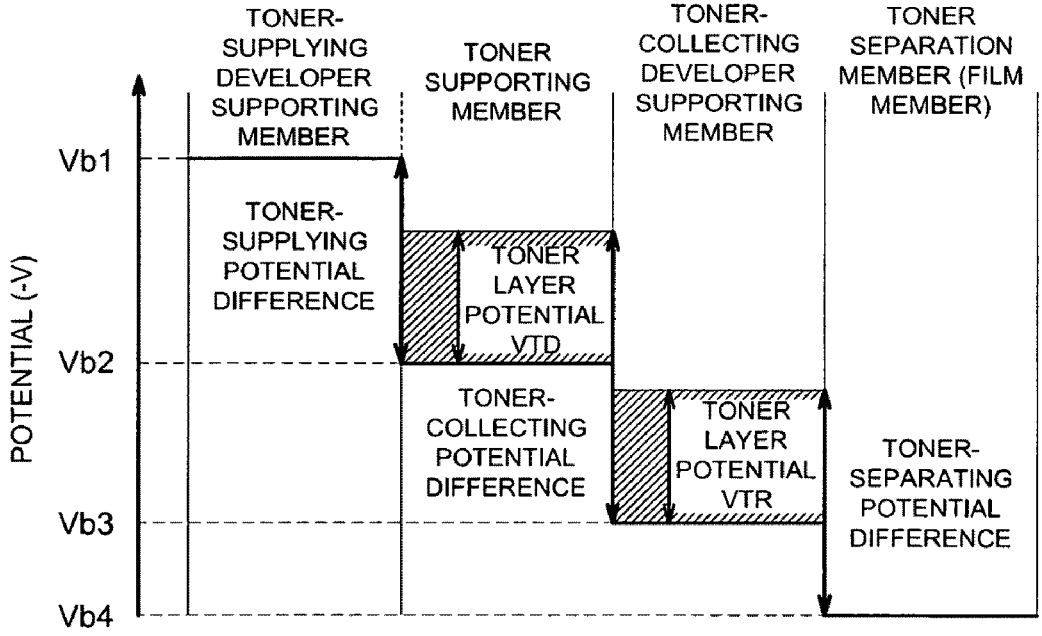

As shown in FIG. 6*b*, a situation is considered in which a certain amount of toner layer (toner layer potential Vtr) is formed on the toner-collecting developer supporting member.

The toner layer unevenly distributed on the surface of the toner-collecting developer supporting member 26 (toner layer potential Vtr) is attracted in the direction toward the toner separation member (film member) 41 by the effect of an effective toner-separating potential difference Vb4–(Vb3+Vtr), and is removed. Because of this, Vtr is decreased and the toner-collecting potential difference Vb3–(Vb2+Vtd) between the toner supporting member 25 and the toner-collecting developer supporting member 26 is no longer cancelled out by the toner layer potential Vtr generated by the toner layer formed on the toner-collecting developer supporting member 26.

Figure 7A:
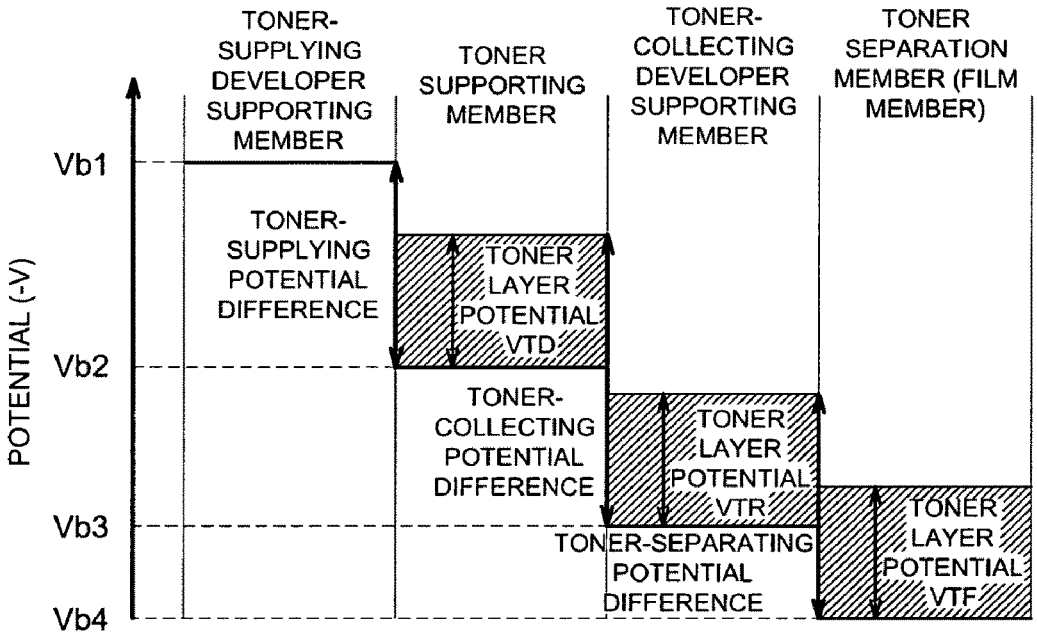
FIGS. 7*a* and 7*b* show a relationship 2 between the bias voltage and the toner layer potential when the toner separation member (film member) 41 is provided.

However, as shown in FIG. 7*a*, there is a concern here that a toner layer (toner layer potential Vtf) might be formed on the toner separation member (film member) 41 due to the toner layer on the toner-collecting developer supporting member 26 (toner layer potential Vtr) being attracted toward the toner separation member (film member) 41 by a toner-separating potential difference Vb4–(Vb3+Vtr).

In other words, if the toner layer on the toner separation member (film member) 41 (toner layer potential Vtf) is increased by repeated operations, the effective toner-separating potential difference becomes smaller with the toner-separating potential difference Vb4–(Vb3+Vtr) being cancelled out by the toner layer potential Vtf.

However, almost no toner layer (toner layer potential Vtf) is formed on the toner separation member (film member) 41 because of the following reasons.

Figure 8A:
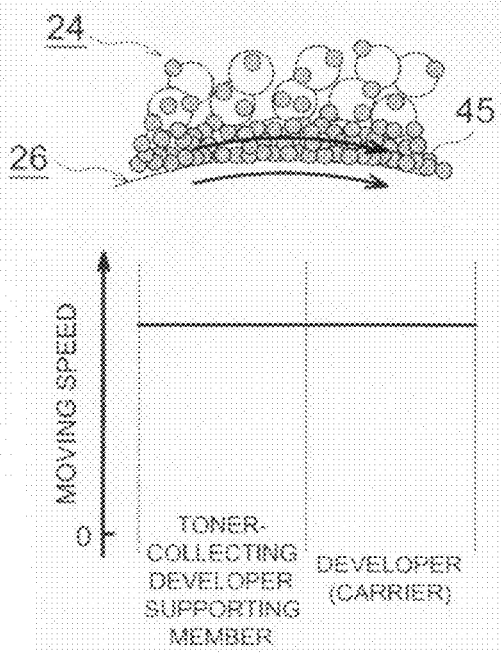
FIGS. 8*a* and 8*b* illustrate an appearance of a toner layer attached to the toner separation member (film member).

As shown in FIG. 8*a*, since the developer 24 moves being attached to the toner-collecting developer supporting member 26 by magnetic force, the moving speed of the developer 24 on the toner-collecting developer supporting member 26 is approximately the same as the moving speed of the surface of the toner-collecting developer supporting member 26 (sleeve roller 27), which means that there is no speed difference at the interface between the toner-collecting developer supporting member 26 and the developer 24.

Therefore, no frictional force works against the layer of toner 45 formed on the toner-collecting developer supporting member 26; the layer of toner 45 cannot be removed using the developer 24.

Figure 8B:
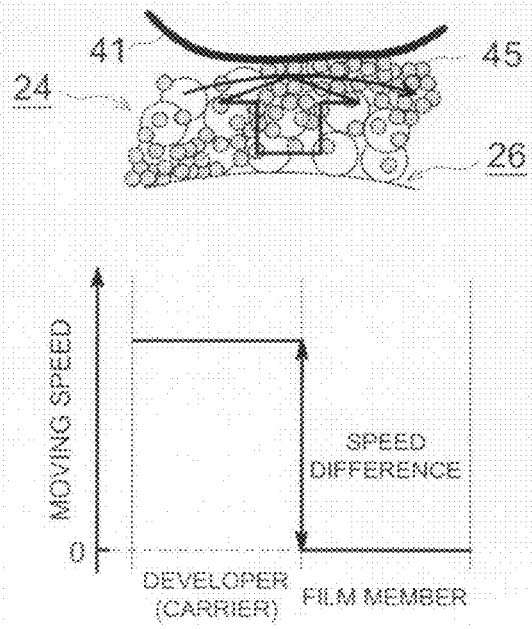

On the other hand, as shown in FIG. 8*b*, when the toner separation member (film member) 41 is provided, the toner 45 is attracted toward the toner separation member (film member) 41 by the toner-separating electric field; however, a close look at the abutting nip portion of the toner separation member (film member) 41 to the developer 24 on the toner-collecting developer supporting member 26 shows that while the toner separation member (film member) 41 is fixed, the developer 24 is moving with the rotation of the toner-collecting developer supporting member 26.

This results in a speed difference at the interface between the toner separation member (film member) 41 and the developer 24, and even if a layer of toner 45 is formed on the film member 41 by the toner-separating electric field, it will be removed by frictional force of the developer 24 to the layer of toner 45, and no toner layer will be accumulated on the film member 41.

Figure 7B:
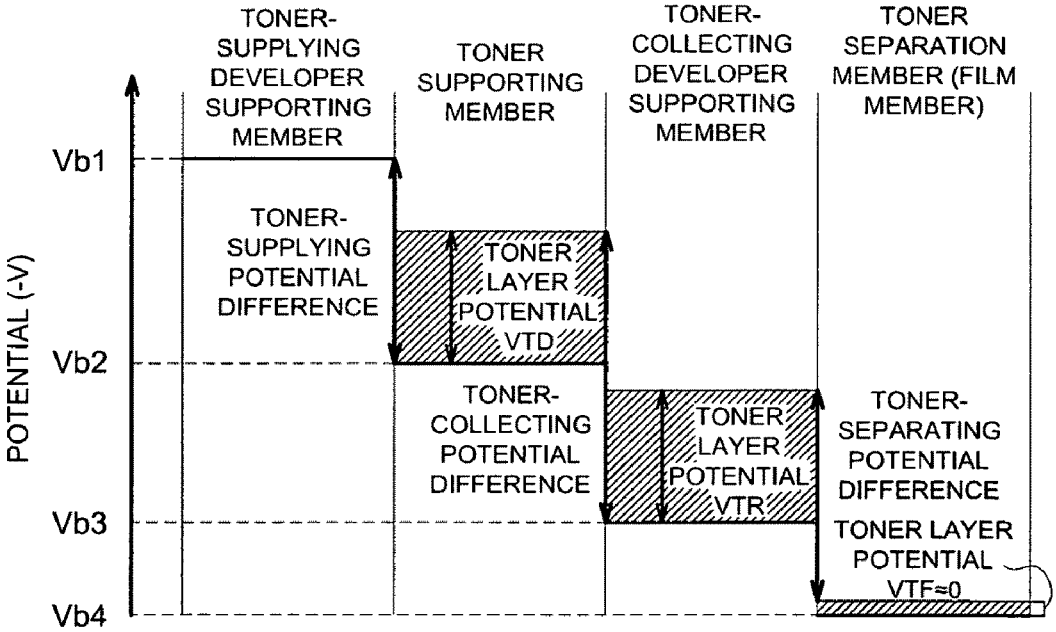

Because of this effect, as shown in FIG. 7*b*, the toner layer potential Vtf on the film member 41 will not be increased by repeated operations; it is limited to zero or an extremely small level. Thus, the toner-separating potential difference can be maintained at a stable level.

From above, the toner-separating potential difference Vb4–(Vb3+Vtr) can at least be set to a negative value when positively-charged toner is used, and to a positive value when negatively-charged toner is used. In addition, the electric field between the film member 41 and the toner-collecting developer supporting member 26 should preferably be a vibrating electric field.

By applying a vibrating electric field between the film member 41 and the toner-collecting developer supporting member 26, the toner adhered onto the toner-collecting developer supporting member 26 can be almost entirely attached to the film member 41.

(State Change of a Toner Layer at Each Nip Portion)

Figure 9:
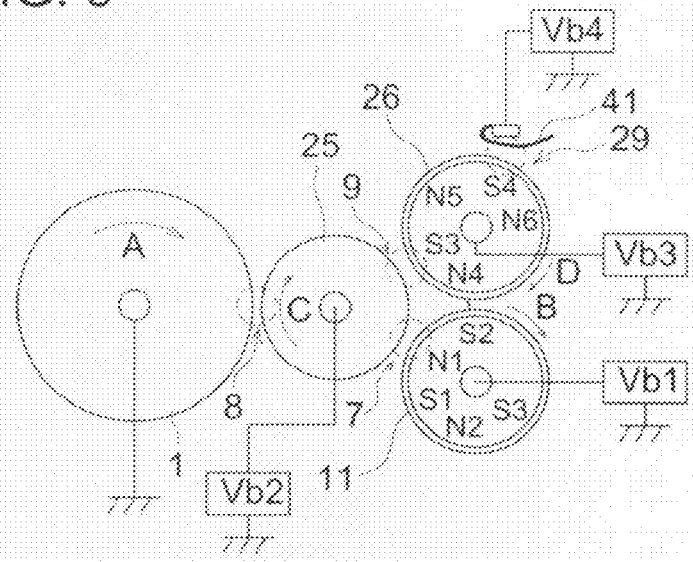
FIG. 9 shows the main part picked up from FIG. 1.

FIGS. 10 to 13 show, in an orderly manner, the states of a toner layer on each member before and after passing each nip portion when the toner separation member (film member) 41 is provided. In this description, the voltage setting for each member is only an example, and not necessarily limited to that. FIG. 9 is the main part of FIG. 1 selected for reference.

Figure 10:
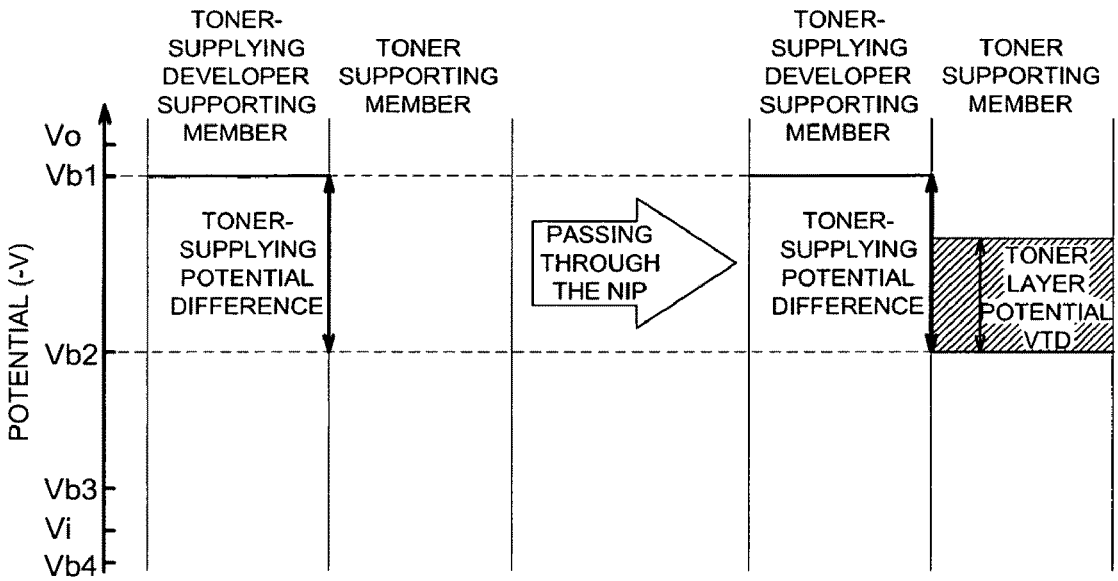
FIG. 10 shows a change in a toner layer on each member after passing through a toner supply area 7.

[1] In a toner supply area 7, as shown in FIG. 10, no toner is on the toner supporting member 25 before passing through the nip, but by passing the nip, the toner, and only the toner is supplied from the developer on the toner-supplying developer supporting member 11 to the toner supporting member 25 so as to fill the toner-supplying potential difference formed between the toner-supplying developer supporting member 11 and the toner supporting member 25.

[2] In a development area 8, an image portion and a non-image (background) portion behave differently.

Figure 11A:
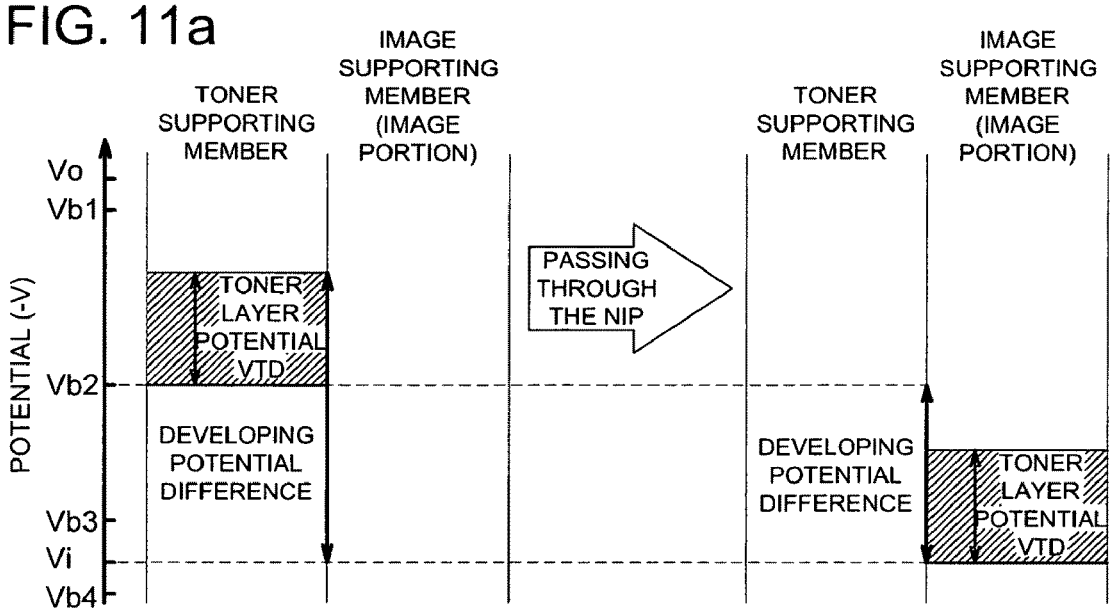
FIGS. 11*a* and 11*b* show a change in the toner layer on each member after passing through a development area 8.

In the image portion, as shown in FIG. 11*a*, the toner existing on the toner supporting member 25 before passing through the nip is, by passing the nip, transferred from the toner supporting member 25 to the image portion of an image supporting member 1 so as to fill the developing potential difference formed between the toner supporting member 25 and an image portion potential Vi of the image supporting member 1, and the amount of toner on the toner supporting member 25 is reduced (in the figure, it is completely transferred).

Figure 11B:
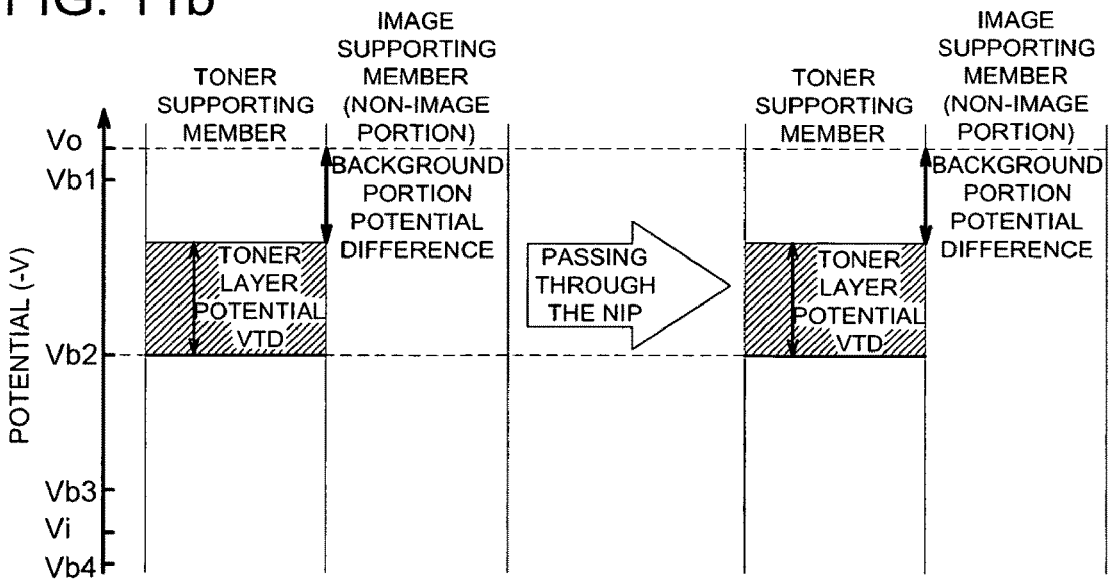

On the other hand, in the non-image portion, as shown in FIG. 11*b*, the toner existing on the toner supporting member 25 before passing the nip is not moved by passing the nip, from the toner supporting member 25 to the non-image portion of the image supporting member 1 due to the background-portion potential difference formed between the toner supporting member 25 and a non-image portion potential Vo of the image supporting member 1, thus the toner remains on the toner supporting member 25.

This causes a development hysteresis on the toner supporting member 25 as a difference in the amount of post-development residual toner.

[3] In a toner collection area 9, actions will be different depending on whether the development hysteresis exists.

Figure 12A:
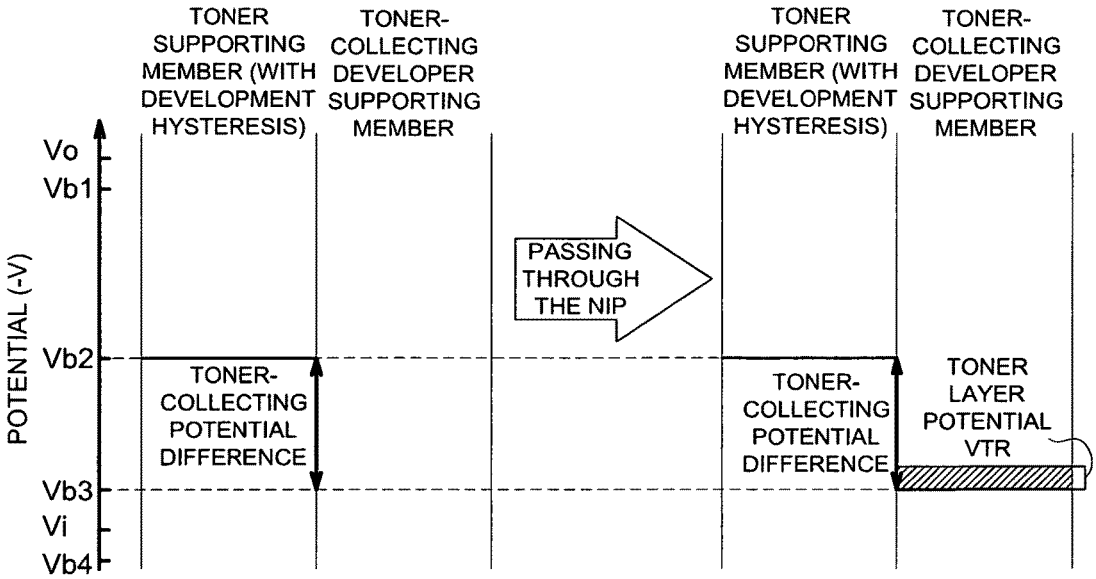
FIGS. 12*a* and 12*b* show a change in the toner layer on each member after passing through a toner collection area 9.

In the portion subjected to the development hysteresis, as shown in FIG. 12*a*, no toner exists on the toner supporting member 25 before passing the nip (or only a little toner exists compared to the non-image portion), and toner is prevented from transferring onto the toner supporting member 25 even when passing through the nip by the toner-collecting potential difference formed between the toner supporting member 25 and the toner-collecting developer supporting member 26. When there is residual toner on the toner supporting member 25 after development, the toner on the toner supporting member 25 is collected by the toner-collecting developer supporting member 26.

However, since the developer 24 is on the toner-collecting developer supporting member 26, a part of the toner contained in the developer adheres to the surface of the toner-collecting developer supporting member 26 due to the toner-collecting potential difference.

Figure 12B:
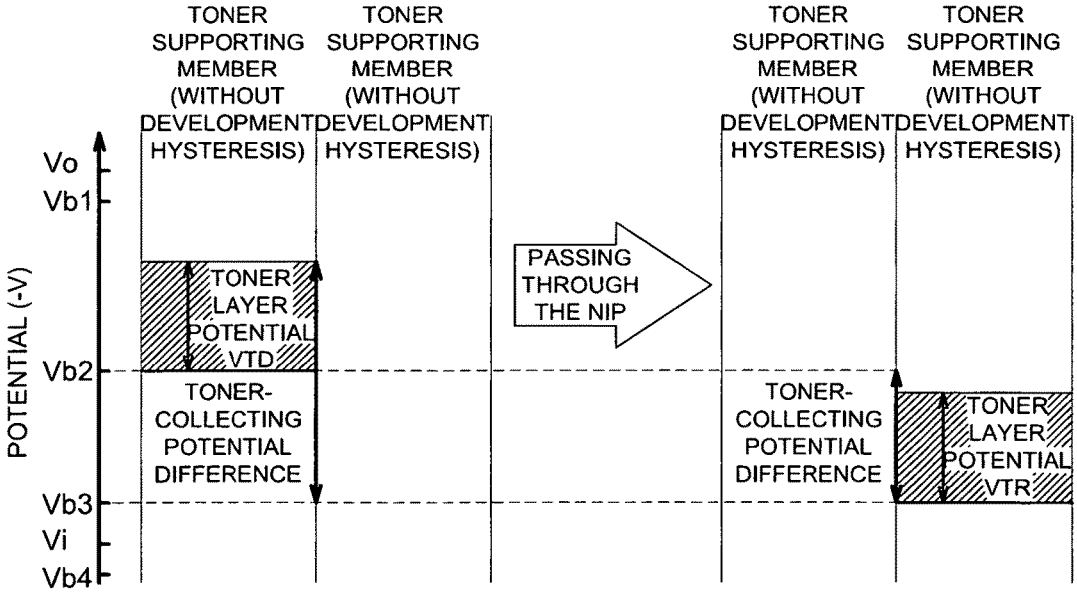

On the other hand, in the portion without the development hysteresis, as shown in FIG. 12*b*, the post-development residual toner existing on the toner supporting member 25 before passing through the nip is collected when passing the nip, from the toner supporting member 25 to the toner-collecting developer supporting member 26 so as to fill the toner-collecting potential difference formed between the toner supporting member 25 and the toner-collecting developer supporting member 26.

Thus, the development hysteresis on the toner supporting member 25 caused by the post-development residual toner is reset, and the toner supporting member 25 returns to the state of [1], which is before passing through the nip. On the other hand, the effect of the development hysteresis on the toner supporting member 25 is transferred to the toner-collecting developer supporting member 26, and remains as a difference in the amount of toner attached to the toner-collecting developer supporting member 26.

Figure 13:
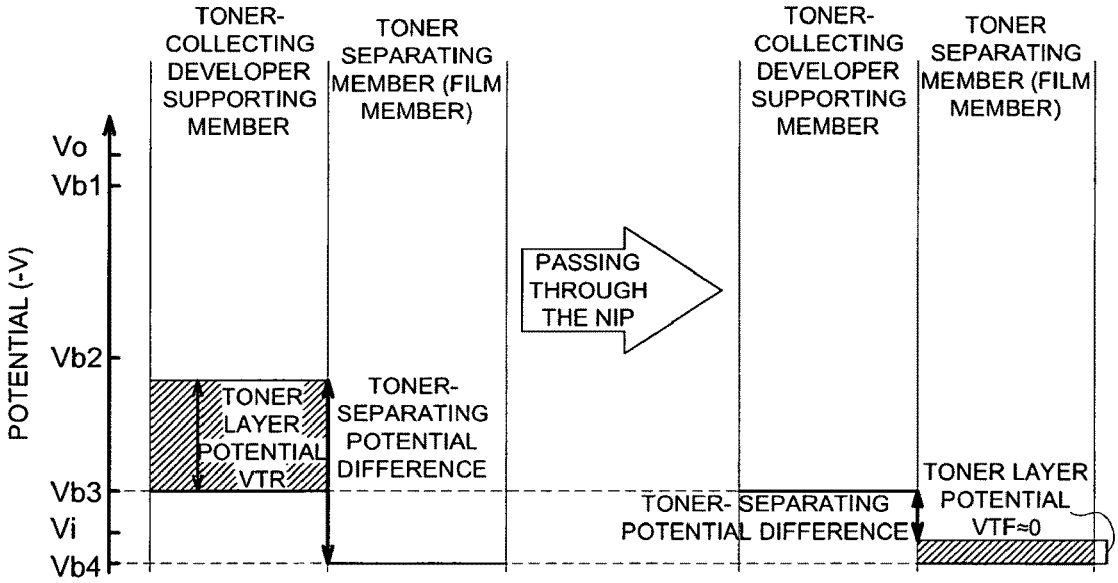
FIG. 13 shows a change in a toner layer on each member after passing through a toner separation area 29.

[4] In a toner separation area 29, since no toner will accumulate on the toner separation member (film member) 41, the amount of toner attached to the toner-collecting developer supporting member 26 does not matter. As shown in FIG. 13, the toner attached to the toner-collecting developer supporting member 26 before passing through the nip is, when passing through the nip, lifted from the toner-collecting developer supporting member 26 toward the toner separation member (film member) 41 so as to fill the toner-separating potential difference formed between the toner-collecting developer supporting member 26 and the toner separation member (film member) 41.

Simultaneously, the toner attached to the toner separation member (film member) 41 is scrubbed by the developer 24 on the toner-collecting developer supporting member 26, so that no toner remains on the toner separation member (film member) 41. In a developer separation area, the toner is retuned to the developer tank 16 by the repulsive magnetic field formed between the homopolar magnetic poles N6 and N4 contained in the toner-collecting developer supporting member 26.

Thus, the toner attached onto the toner-collecting developer supporting member 26 is reset, and the toner-collecting developer supporting member 26 returns to the state of [3], which is before passing through the nip.

(Material and Structure of the Toner Separation Member)

As described above, in order for the toner separation member (film member) 41 of the present embodiment to properly function, the followings are required:

(a) the toner-separating potential difference for attracting the toner layer on the toner-collecting developer supporting member 26 toward the toner separation member (film member) 41 be formed, and (b) the toner attached to the toner separation member (film member) 41 by the toner-separating potential difference be scraped off by the magnetic brush of the developer 24 and toner accumulation onto the toner separation member (film member) 41 be controlled.

Preferably, a film material should be used for the toner separation member. Use of the film material has some advantages such as the ease of obtaining a long abutting nip length to the developer and the ease of obtaining an appropriate, reliable abutting pressure to the developer.

By having a long abutting nip length to the developer, time is secured for the toner attached to the toner-collecting developer supporting member to move, through the developer layer, toward the film member by the toner-separating electric field formed between the toner-collecting developer supporting member and the film member. This allows an operation with a smaller electric field or a faster system speed.

By setting the abutting pressure against the developer at an appropriate level, the film member and the developer can reliably contact with each other, and the toner pulled onto the film member can be adequately scraped off by the developer. In addition, even when the amount of carried developer is increased due to environment or a long operating time, the problem that the developer which can not pass through the abutting portion of the film member is piled up at the nip entrance is prevented.

Material for the film member has no special limitation. Thin metallic films of phosphor bronze, nickel, and SUS; films made of polyester resin, polycarbonate resin, acrylic resin, polyethylene resin, polypropylene resin, urethane resin, polyamide resin, polyimide resin, polysulfone resin, polyether ketone resin, vinyl chloride resin, polyvinyl acetate resin, silicone resin, and fluorine resin; and rubber films made of silicone rubber, urethane rubber, nitrile rubber, natural rubber, isoprene rubber, and so on, are some examples, but the materials are not limited to these.

The film material may be single-layered, or laminated if needed. A material with low surface energy (for example, fluorine resin or silicone resin) is desirable to use from the viewpoint of scraping off the attached toner on the film member by the scrubbing force of the developer. Furthermore, use of a material with an electrification property that removes electricity from the toner (for example, fluorine resin for negatively charged toner) is desirable.

The low surface energy and the electrification property of the film member may be obtained through film material, or they can be controlled by adding a low surface energy material such as silicon compound, fluorine compound, etc., to the bulk or by coating the film with such material.

As described above, the toner layer on the surface of the toner-collecting developer supporting member 26 is pulled off and attracted toward the toner separation member (film member) 41 by the toner-separating potential difference, but there is the possibility that the toner may attach onto the toner separation member (film member) 41 by the toner-separating potential difference. The attached toner should be efficiently scraped off by the magnetic brush of the developer 24 and toner accumulation on the toner separation member (film member) 41 should be prevented.

From the viewpoint of scraping off the toner attached to the film member by frictional force of the developer, the triboelectric charging polarity of the film member to the carrier should be preferably the same as the polarity of the toner.

If the triboelectric charging polarity of the film member to the carrier is the same as the polarity of the toner, the film member will be charged to the same polarity as the toner by scrubbing of the magnetic brush of the carrier, and the attached toner can be easily scraped off by the magnetic brush (carrier) due to repulsion of the film to the attached toner.

In addition, electric charge is removed from the toner, and the toner is prevented from re-adhering to the toner-collecting developer supporting member; thus, toner accumulated on the toner-collecting developer supporting member can be effectively removed.

To measure the triboelectric charging property of the film member, a work function, which has a good correlation with triboelectric charging polarity, may be measured and compared with that of the carrier. However, it is simpler to just measure the amount of triboelectric charge generated by actually rubbing the film member and the carrier material together (see examples 2 to 7 described below).

In addition, roughness of the film surface may be considered to reduce the attachment force of toner. The arithmetic average surface roughness Ra of the surface of the film member abutting to the developer is preferably 0.01 μm to 2 μm. If the surface roughness is too small, the attachment force between the film member and the toner will be too large, making the scraping very difficult. If the surface roughness is too large, the surface bumps of the film member acts against the scrubbing by the developer, causing poor scraping.

To obtain a desired surface roughness for the film member, a roughness adjuster can be added to the bulk or the surface of the film member as necessary. As the roughness adjuster, for example, inorganic particles such as silica, titanium oxide, alumina, calcium carbonate, etc., and resin particles such as PMMA, etc., may be used, but the material is not limited to these. In addition, a conductive agent such as carbon black to be described later may be used as the roughness adjuster.

Furthermore, especially when the flexed film member is abutted to the developer, an appropriate abutting pressure can be obtained by selecting a proper shape (thickness and length) according to the degree of elasticity of the material used.

There is no particular limitation to the electric resistance of the film material as long as an electric field can be formed between the film member and the toner-collecting developer supporting member. A conductive material such as a sheet of metal may be used or even an insulating material such as a resin film may be used if an electrode is formed on its back surface by metal vapor deposition and the like.

However, when the conductivity is high, the toner-separating potential difference needs to be set within a range that will not allow leakage between the film member and the toner-collecting developer supporting member. Use of the insulating film narrows the range of material selections since there is concern that triboelectricity between the insulating film and the developer may charge the insulating film, consequently cancelling out the toner-separating potential difference.

From such viewpoints, the resistance of the film material is preferably from $10^{-4}$ to $10^{-10}$ Ω/□. To obtain such an appropriate resistance for the film member, a conductive agent may be added to the bulk or the surface of a resin film or a rubber film as necessary. As such a conductive agent, an electric conductive agent or an ion conductive agent may be used.

As the electric conductive agent, carbon black such as Ketzin black, acetylene black, furnace black, etc., metallic powder, and metallic oxide particles may be used, but the material is not restricted to these. Examples of the ion conductive agent include cationic compounds such as quaternary ammonium salt, amphoteric compound, and ionic high-polymer material, but not limited to these.

The thickness of the film member may be from 5 μm to 1 mm, and preferably from 10 μm to 200 μm. If the film is too thin, it is not strong enough. If the film is too thick, the abutting pressure of the film member to the developer layer may be exceedingly large depending on the degree of elasticity of the film member and the length from the supporting point to the abutting portion of the film, and may cause developer spillage by stopping the developer at the abutting portion. Furthermore, a problem of insufficient contact nip length to the developer may arise.

The film member may be held by fixing it to a holding electrode for applying bias voltage. The holding method may be either a one-end support type in which the other end is free or a two-end support type in which the two ends are fixed. Furthermore, the film member may be made into a cylindrical sleeve and fixed to the holding electrode.

The abutting of the film member fixed to the holding electrode, against the developer layer may be achieved by the elastic resilience of the film member, or by electrostatic attraction power due to the potential difference provided between the film member and the toner-collecting developer supporting member. The material (the degree of elasticity) and shape (length and thickness) of the film member can be appropriately selected according to the abutting method.

Figure 14A:
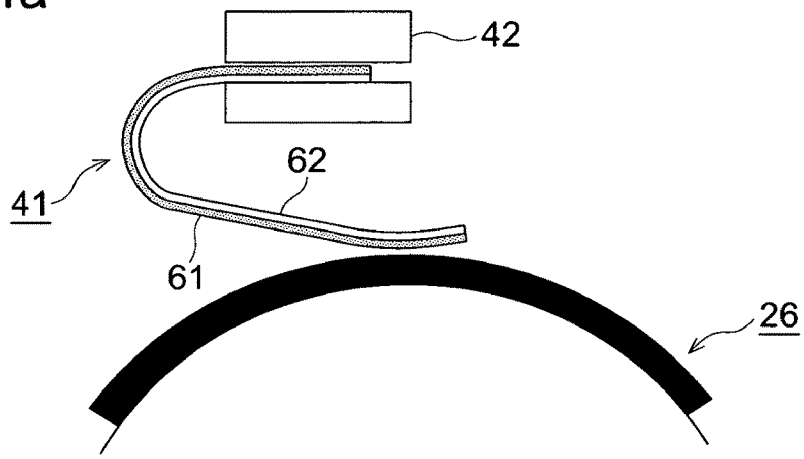
FIGS. 14*a*, 14*b*, and 14*c* are enlarged views of the abutting portion of the toner separation member (film member) 41.
Figure 14B:
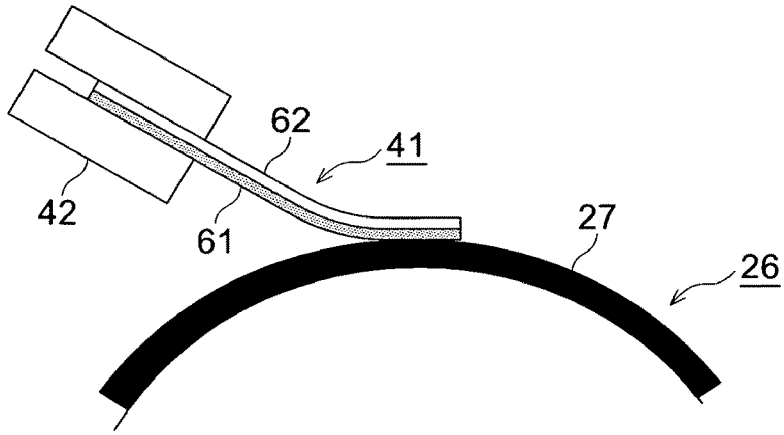

FIGS. 14*a* and 14*b* show examples in which the resilience against elastic deformation is used for abutting the film member 41. The holding method is a one-end support type with the other end being free. FIGS. 14*a* and 14*b* show different holding methods, but both methods use the elastic resilience of the film member 41 for abutting.

In both FIGS. 14*a* and 14*b*, the film member 41 has a laminated structure of a first film member 61 and a second film member 62. The first film member 61 is a conductive film member, and the second film member 62 is a film member having less deteriorative resilience than the first film member 61.

Such a structure is preferred to control the loss of resilience of the film member against elastic deformation due to a bad environment or a long operating time described below.

That is, if the film member is single-layered, creep caused by heat is likely to occur depending on the material. In particular, the deformation may not be restored if the resilience is reduced during high temperature storage. If the resilience against deformation is reduced, abutting force to the toner-collecting developer supporting member decreases, so that toner will be attached to film member, thereby reducing the electric field, and control against toner accumulation will be reduced.

In particular, in the present embodiment, conductive particles are distributed inside the film member to make the member conductive, and these particles may promote creep.

Therefore, in the examples of FIGS. 14*a* and 14*b*, the creep-resistant second film member 62 is laminated behind the first film member 61 having conductive and triboelectric charging properties, to constitute the film member 41 as the toner separation member. This structure controls the loss of resilience by creep or the change in the abutting force, and toner accumulation onto the toner-collecting developer supporting member can be reliably prevented (see examples 14 and 15 below).

The second film member is not required to be made of a conductive material, but a creep-resistant material that rarely changes its resilience against elastic deformation should be selected. See Examples 14 and 15 below with regard to the method for evaluating the elastic resilience of the film member.

As such a material, a resin material is preferred which contains less additive agent, such as a conductive agent, than the material for the first film member. For example, polyimide, polystyrene, polyethylene, polyamide, vinyl chloride, vinylidene chloride, polypropylene, polyethylene terephthalate, polycarbonate, acrylic, polyether ketone, polyphenylene sulfide, and so on, may be used. With elasticity and deformation-resistance in mind, the thickness of the film should preferably be about from 30 to 300 μm.

If the abutting of the film member to the toner-collecting developer supporting member is achieved by magnetic attractive force, the loss of abutting pressure of the film member by creep deformation is unlikely to happen, and a stable abutting pressure can be maintained for a long period of time.

The abutting of the film member to the toner-collecting developer supporting member using the magnetic attractive force can be achieved by providing a magnetic member behind the abutting film member.

Figure 14C:
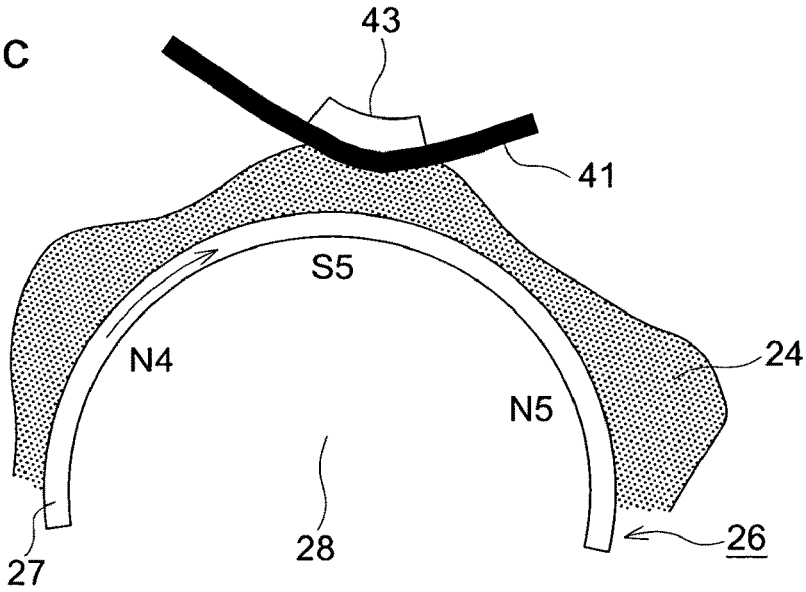

As shown in the enlarged view of the abutting portion of the film member in FIG. 14*c*, since a magnetic member 43 is provided behind the film member 41, the magnetic member 43 is attracted toward the toner-collecting developer supporting member 26 by the magnetic attractive force generated by the magnetic field formed by magnetic poles in the toner-collecting developer supporting member 26. In this way, the abutting pressure of the film member 41 to the developer layer 24 on the toner-collecting developer supporting member 26 can be obtained.

Now, flexibility of the film member 41 must be kept while the film member is abutting against the developer layer 24 by magnetic attractive force acting on the magnetic member 43. If the flexibility of the film member is lost, not only the uniformity of the abutting pressure of the film member against the developer is lost, but also the abutting nip width between the film member and the developer becomes narrower.

In FIG. 14*c*, it is preferable that the magnetic member 43 is not bonded to the film member 41, but the film member and the magnetic member should be disposed independently and movably such that the magnetic member 43 is movable in the normal direction of the surface of the toner-collecting developer supporting member with a guide provided on a housing side plate.

Figure 15A:
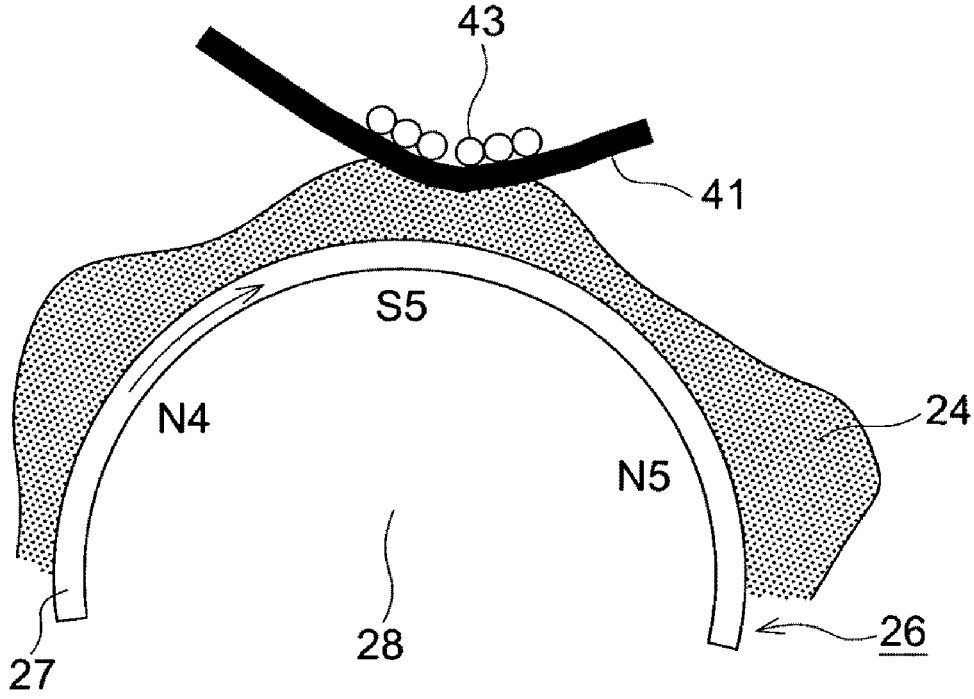
FIGS. 15*a* and 15*b* show an example in which a discontinuous material (magnetic particles) is used as the magnetic member for the toner separation member (film member) 41.
Figure 15B:
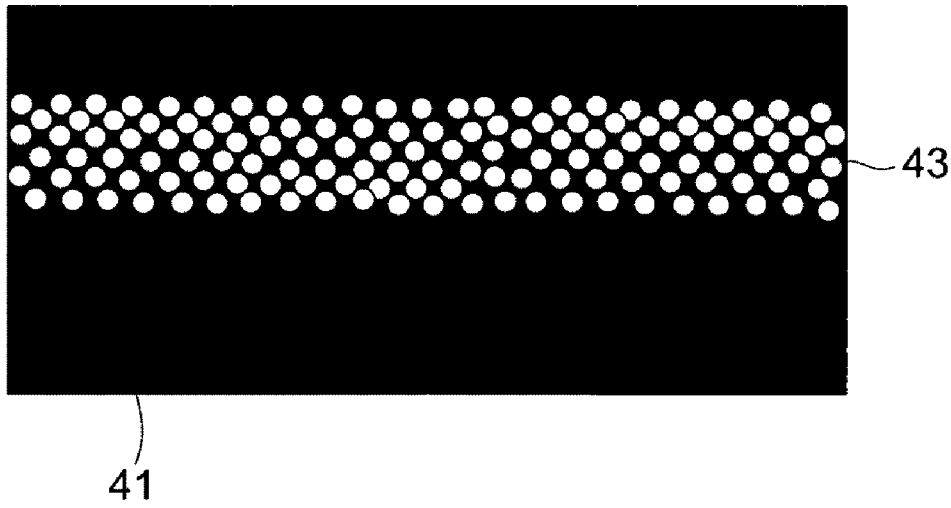

As shown in the cross-sectional view of the abutting portion in FIG. 15*a* and the top view of the film member in FIG. 15*b* as examples, because the magnetic member is made to be discontinuous, instead of continuous, in the longitudinal direction and the circumferential direction of the toner-collecting developer supporting member, the flexibility of the film is kept even when the magnetic member is fixed to the film member and the abutting pressure by magnetic attractive force is secured.

In the same manner, magnetic particles can be distributed inside the film member as the magnetic member to make the magnetic member itself flexible. In this way, both the abutting pressure of the film member to the developer by magnetic attractive force and the abutting nip width is appropriately obtained. The same effect can be obtained by extending flexible magnetic wires on the back of the film.

Furthermore, by distributing magnetic particles inside the film member 41, the magnetic attractive force can now act on the film member 41.

In addition, since the abutting of the film member is achieved by the magnetic attractive force of the magnetic member, stability of the abutting pressure of the film member can is improved. Furthermore, a bridge of the developer is formed between the toner-collecting developer supporting member and the magnetic body, which causes the toner attached to the film member to be effectively scraped off.

Preferably, the film member abuts the developer layer in the vicinity of the magnetic pole of a magnet inside the toner-collecting developer supporting member. If the abutting position is in the vicinity of the magnetic pole, the magnetic brush of the developer will rise, and this arrangement makes it easy for the toner layer attached to the toner-collecting developer supporting member to be lifted toward the film member by the toner-separating electric field, but also makes the scrubbing force of the developer for scraping off the toner attached to the film member greater.

According to the present embodiment, post-development residual toner on the toner supporting member is effectively collected by the toner-collecting developer supporting member, and since toner accumulation onto the toner-collecting developer supporting member is reduced, a even toner layer is always supplied onto the toner supporting member.

In this way, the developing device and the image forming apparatus are provided, which can maintain its toner collecting ability and can yield high-quality images without ghost problems for a long period of time.

As described above, in the developing device and the image forming apparatus of the present embodiment, the toner separation member is provided which abuts against the toner-collecting developer supporting member through the toner-collecting developer layer at the downstream of the toner collection area, and an electric field in such a direction as to pull the toner away from the toner-collecting developer supporting member is formed by applying bias voltage. This solves the problem of uneven distribution of toner on the surface of the toner-collecting developer supporting member, prevents the loss of collecting ability caused by toner accumulation, and realizes high-quality images without ghost problems for a long period of time.

EXAMPLES

The advantages of the embodiment were evaluated by using the developing device of the above embodiment, and the results are described below.

The following developing devices corresponding to the developing device 2 are prepared including a device with a film member to function as the toner separation member of the present invention (used for Examples) and a conventional device without the film member (used for Comparative examples).

The image forming device used was bizhubC350 which is an MFP by Konica Minolta Business Technologies, Inc. modified by providing the developing device 2 shown in FIG. 1. The developer for bizhubC350 was used as the developer for the examples. The toner had negative charge, and the toner density of the developer was 8%.

In each developing device, a developing gap between the image supporting member and the toner supporting member was set to 0.15 mm. Each of a toner-supplying gap between the toner supporting member and the toner-supplying developer supporting member, a toner-collecting gap between the toner supporting member and the toner-collecting developer supporting member, and a gap between the toner-supplying developer supporting member and a regulating member was set to 0.35 mm.

The voltage applied to the toner supporting member was a rectangular wave voltage with a peak-to-peak amplitude of 1.4 kV, a DC component of −350V, a frequency of 4 kHz, and a duty ratio of 50%.

The voltage applied to the toner-supplying developer supporting member was set to −550V DC, and the voltage applied to the toner-collecting developer supporting member was set to −200V DC.

The potential of a background portion of the electrostatic latent image formed on the image supporting member was −550V, and the potential of an image portion of the same was −60V.

In Examples and Comparative examples described later, the above image forming apparatuses were used to continuously print 1000 sheets (Example 1 and the Comparative example) or 50 k sheets (Examples 2 to 11) of the image chart shown in FIG. 2*a*, and occurrence of development hysteresis (ghost) was compared between them after certain numbers of prints. In addition, in Examples 12 to 15, these devices were kept at 40° C. for 12 hours followed by a testing of 100-pages continuous printing to compare the occurrence of development hysteresis (ghost).

Area 54 in FIG. 2*b* shows an example of the ghost-image occurrence in the output image. Areas 54 which are lighter than the halftone image portion 53 have appeared at the positions one cycle after the solid black portions 52. The ghost-image occurrence was evaluated by measuring a density of the area 54 corresponding to the solid black portion 52, and a density of the halftone image portion 53 corresponding to the solid white portion 51.

The evaluation of the development hysteresis (ghost) was carried out using a densitometer (X-Rite310 by X-Rite, Inc.) Upon measuring densities of the printed halftone image areas corresponding to the solid black portion and the white portion, when the density difference was 0.05 or lower, it was recorded as {A} (excellent), when the density difference was higher than 0.05 and 0.1 or lower, it was recorded as {B} (good), and anything else was recorded as {C}(ghost-image occurred).

In addition, to check whether toner is accumulated, due to print hysteresis, on the toner-collecting developer supporting member or not, the developing unit was taken out after a certain numbers of prints, and the surface potential of the toner layer still attached to the surface at the homopolar portion (between N4 pole and N6 pole) was measured without becoming separated together with the carrier.

A surface potentiometer Model 344 by TREK, Inc. was used to measure the surface potential, and the measurement was performed while the toner-collecting developer supporting member was grounded. In the evaluation, when the absolute value of the measured toner layer potential was 10V or lower, it was recorded as A (excellent), when it was more than 10V and 100V or lower, it was recorded as B (good), and anything else was recorded as C (poor).

Example 1

A film member 41 was provided, as the toner separation member, in the developing device shown in FIG. 1, facing the magnetic pole S4 in the toner-collecting developer supporting member 26.

As the film member, a film of PTFE in which carbon was distributed throughout, was used which had a film resistance of $10^{-4}$ Ω/□ and a thickness of 80 μm.

The voltage applied to the film member was a rectangular wave voltage with a peak-to-peak amplitude of 1.4 kV, a DC component of 0V, a frequency of 4 kHz, and a duty ratio of 50%.

Comparative Example

The film member 41 was removed from the developing device used in Example 1.

<Evaluation Results of Example 1 and the Comparative Example>

Evaluation results of Example 1 and the Comparative example are shown in Table 1.

TABLE 1

| | Toner separation member | Number of prints | Development hysteresis | Toner layer potential |
|---|---|---|---|---|
| Example 1 | With film member | 1 | A | A |
| | | 10 | A | A |
| | | 100 | A | A |
| | | 1000 | A | A |
| Comparative example | Without film member | 1 | A | B |
| | | 10 | B | C |
| | | 100 | C | C |
| | | 1000 | C | C |

In the table, each of "with film member" and "without film member" in the "toner separation member" column indicates whether the film member is provided as the above-described toner separation member or not.

"Development hysteresis" shows the results of the evaluation of ghost-image occurrence based on the above criteria, and the evaluations were performed at indicated numbers of prints from the 1st print to the 1000th print.

"Toner layer potential" shows the evaluation results of the measurement of a surface potential of the toner-collecting developer supporting member between the N4 and N6 poles based on the above criteria, and these were also evaluated at indicated numbers of prints from the 1st print to the 1000th print.

As it is clear in the comparison between the results of Example 1 of the present invention and the results of the Comparative example in Table 1, the developing device with the toner separation member of the present invention was maintained in the state with almost no toner attached to the toner-collecting developer supporting member. Therefore, it can be expected that resetting of the post-development residual toner on the toner supporting member is stabilized, and consequently, the device can output good stable images.

On the other hand, in the developing device without the toner separation member, a accumulated toner layer was already observed at the 10th print, and the toner collecting ability got lower as the page number went up. On the 100th print, ghost had occurred.

Examples 2 to 11

For Examples 2 to 11, the same evaluations of the development hysteresis as Example 1 were carried out using the endurance test of 50 k pages. The testing conditions were different from Example 1 as follows.

Table 2 shows the film members (Samples A to J) used for the examples.

TABLE 2

| | Film member | | | Work | Carrier | |
|---|---|---|---|---|---|---|
| | Sample symbol | Main material | Thickness (μm) | function Wf (eV) | charge amount (nC) | Film resistance (Ω/□) |
| Examp. 2 | A | PTFE | 80 | 5.4 | 0.92 | $10^3$ |
| Examp. 3 | B | PE | 100 | 4.7 | 0.34 | $10^6$ |
| Examp. 4 | C | PE | 82 | 5.7 | 0.95 | $10^3$ |
| Examp. 5 | D | PTFE | 98 | 4.7 | 0.56 | $10^5$ |
| Examp. 6 | G | PTFE | 85 | 4.5 | 0.23 | $10^4$ |
| Examp. 7 | H | PE | 70 | 4.4 | 0.1 | $10^4$ |
| Examp. 8 | E | PC | 70 | 4.2 | −0.35 | $10^5$ |

TABLE 2-continued

| | Film member | | | Work | Carrier | |
|---|---|---|---|---|---|---|
| | Sample symbol | Main material | Thickness (μm) | function Wf (eV) | charge amount (nC) | Film resistance (Ω/□) |
| Examp. 9 | F | NYLON | 90 | 4.3 | −0.41 | $10^6$ |
| Examp. 10 | I | PE | 100 | 4.1 | −0.2 | $10^4$ |
| Examp. 11 | J | PET + AI | 100 | 3.8 | −0.8 | — |

In the film used for each of the examples except for Example 11 (Samples A to I), carbon was added as a conductive material at different additive rates to the respective resin base shown in Chart 2. Each film material actually used is shown below.

Sample A was a PTFE film "Niftron" by Nitto Denko Corp. Sample B was a PE film "Cropoly" by Achilles, Inc. Sample C was a PE film "Valqua sheet" by Nippon Valqua Industries, Ltd. Sample D was a PTFE film "Skived tape" by Chukoh Chemical Industries, Ltd. Sample G was a PTFE film "Valfron" by Nippon Valqua Industries, Ltd. Sample H was a PE film "New Light Film" by Saxin Corp. Sample F was a nylon film "MS Sheet" by Gunze, Ltd. Sample I was a PE film "Bearee UH3954" by NTN Engineering Plastics Corp. Sample J was an Al-deposited film "Metalme" by Toray Industries, Inc.

For Sample E, a PC film made in the following way was used. First, tin oxide powder (Bastran Type IV4310 by Mitsui Mining & Smelting Co., Ltd.) was dispersed in tetrahydrofuran, and polycarbonate (Vanlight C1400 by Teijin, Ltd.) was dissolved. A solid content of the solution was 17%, and the ratio between the polycarbonate and the tin oxide powder was set such that the tin oxide powder to the polycarbonate was 40 percent by mass. After the solution was applied onto an aluminum substrate by a bar code method, it was dried at 100° C. for 30 minutes. The coating film was easily separated from the aluminum substrate, and a film of approximately 70 μm was obtained.

The thickness of each film member was from 70 to 100 μm, and the film resistance was from $10^3$ to $10^6$ Ω/□. For Example 11 (Sample J), an Al-deposited PET film was used, disposed in such a way that the Al surface was facing the toner-collecting developer supporting member.

A work function Wf for each example in Table 2 was obtained by measuring the contact potential difference to gold. Surface Potential Meter (Type SSVII-10) by Kawaguchi Electric Works Co., Ltd. was used for measuring the contact potential difference to gold.

The measured contact potential difference was obtained by calculation supposing the work function of gold as 4.8 eV. The results indicated that PTFE materials tend to be charged negatively while nylon and aluminum tend to be charged positively. Furthermore, it seems that the same polyesters could show different results depending on their composition and additives.

Figure 16:
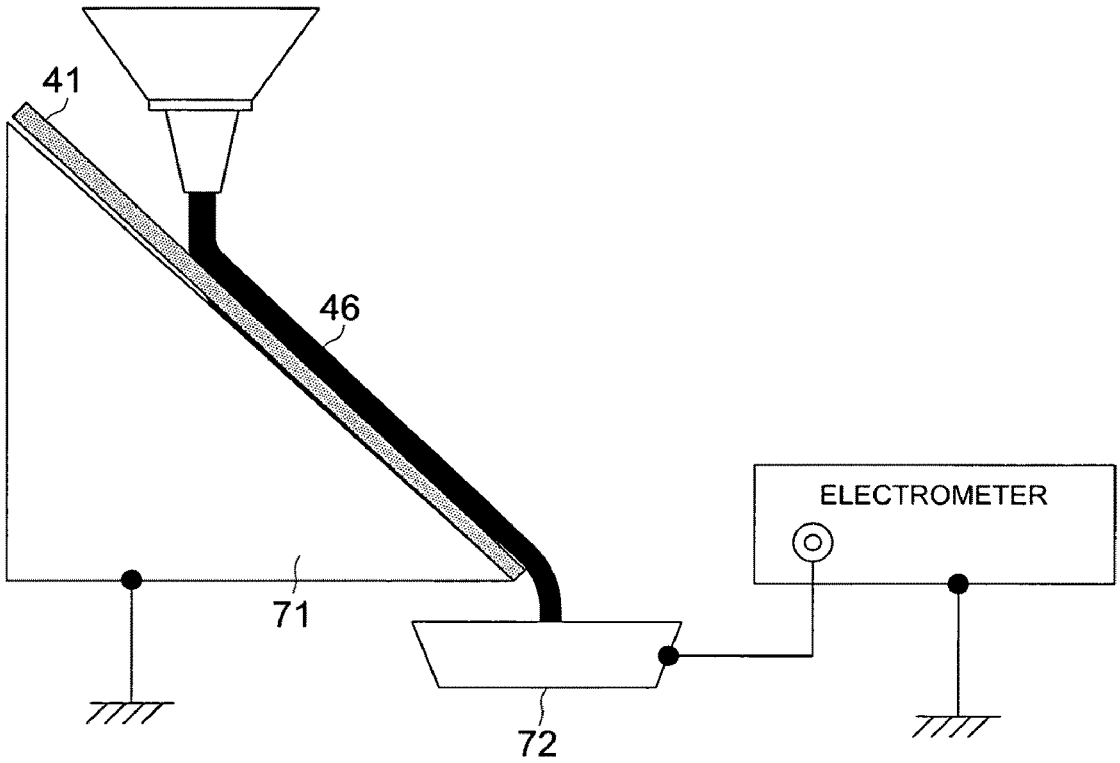
FIG. 16 is an example showing a structural framework of a device for measuring the charge amount of carrier to check the triboelectric charging property of a film member to the carrier.

A carrier charge amount for each example in Table 2 was obtained using a device shown in FIG. 16, measuring the triboelectric charging amount between each film and the carrier.

The measuring method was as follows: the film 41 to be measured was pasted onto a sloping metal plate 71; a carrier 46 was dropped onto it and became charged as it slid down the slope. The carrier 46 that slid off the slope was collected in a metal container 72, and an electrometer (Electrometer Type TR8652 by Advantest) connected to the metal container 72 was used to measure the carrier charge.

The results indicated that the film members of Examples 2 to 7 were charged negative with respect to the carrier, which is the same polarity as the toner, while the film members of Examples 8 to 11 were charged positive with respect to the carrier, which is opposite to the toner.

<Evaluation Results of Examples 2 to 11>

Evaluation results of Examples 2 to 11 are shown in Table 3.

TABLE 3

| | Sample symbol | Number of prints | Development hysteresis | Toner layer potential |
|---|---|---|---|---|
| Example 2 | A | 1 | A | A |
| | | 1k | A | A |
| | | 10k | A | A |
| | | 50k | A | A |
| Example 3 | B | 1 | A | A |
| | | 1k | A | A |
| | | 10k | A | A |
| | | 50k | A | A |
| Example 4 | C | 1 | A | A |
| | | 1k | A | A |
| | | 10k | A | A |
| | | 50k | A | A |
| Example 5 | D | 1 | A | A |
| | | 1k | A | A |
| | | 10k | A | A |
| | | 50k | A | A |
| Example 6 | G | 1 | A | A |
| | | 1k | A | A |
| | | 10k | A | A |
| | | 50k | A | A |
| Example 7 | H | 1 | A | A |
| | | 1k | A | A |
| | | 10k | A | A |
| | | 50k | A | A |
| Example 8 | E | 1 | A | A |
| | | 1k | A | A |
| | | 10k | A | B |
| | | 50k | B | B |
| Example 9 | F | 1 | A | A |
| | | 1k | A | A |
| | | 10k | A | B |
| | | 50k | B | B |
| Example 10 | I | 1 | A | A |
| | | 1k | A | A |
| | | 10k | A | B |
| | | 50k | B | B |
| Example 11 | J | 1 | A | A |
| | | 1k | A | A |
| | | 10k | B | B |
| | | 50k | B | B |

In the table, "development hysteresis" shows the results of evaluation for ghost-image occurrence based on the above criteria, and the evaluations were performed at indicated numbers of prints from the 1st print to the 50 kth print.

"Toner layer potential" shows the evaluation results of the measurement of surface potential of the toner-collecting developer supporting member between the N4 and N6 poles based on the above criteria, and these were also evaluated at indicated numbers of prints from the 1st print to the 50 kth print.

Table 3 shows that all Examples 2 to 11 of the present invention maintained excellent image output (A) in the continuous printing of up to 1 k sheets. As it is clear in the comparison with the results of the Comparative example in Table 1, the developing device with the toner separation member of the present invention was maintained in the state with almost no toner attached to the toner-collecting developer supporting member.

In the continuous printing of up to 50 k sheets, all the examples maintained the image output of good (B) or higher. In particular, Examples 2 to 7 maintained excellent image output (A) up to 50 k.

In other words, when the triboelectric charging property of the film member to the carrier shows the same polarity as the toner, toner accumulation is controlled for an especially long period of time, and good images are reliably obtained.

Examples 12 to 15

In Examples 12 to 15, each film member was disposed in the developing device shown in FIG. 1, facing the magnetic polar S4 in the toner-collecting developer supporting member. After each device was kept in a constant temperature chamber of 40° C. for 12 hours, the endurance test of 100 sheets was carried out and development hysteresis was evaluated in the same manner as in Example 1.

Table 4 shows the symbol of sample of the film member used in each example. That is, Samples A and C shown in Table 2 were used as the film member.

Examples 12 and 13 simply used Samples A and C as their film member, respectively.

Examples 14 and 15 used laminated film members, in which a 60 μm PET film was pasted as the second film member onto Samples A and C as the first film member respectively, and each film member was disposed facing the toner-collecting developer supporting member (see FIG. 4*b*).

As described above, the constant temperature chamber was set to 40° C., and after the development device provided with each film member was kept inside for 12 hours, it was set to bizhubC350, and the endurance test of 100 sheets was carried out to evaluate in the same way as in Example 1.

Note that the 60 μm PET film was selected as the second film member because, as described above, its resilience against elastic deformation was less likely to be reduced than the first film member. The resilience against elastic deformation can be evaluated using an evaluation device shown in FIGS. 17*a* and 17*b* for example.

Figure 17A:
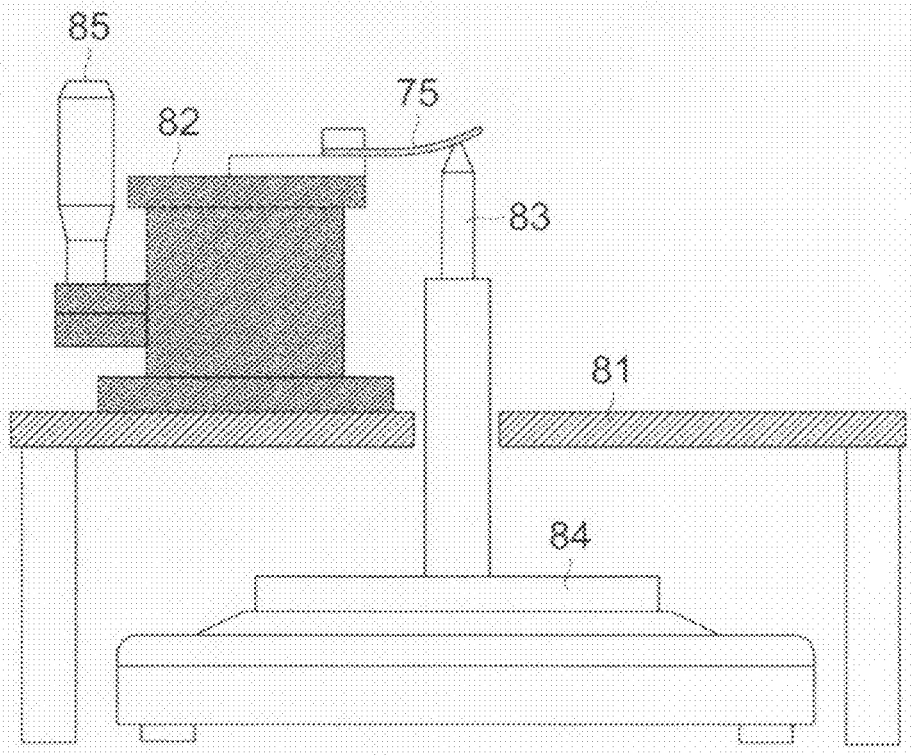
FIGS. 17*a* and 17*b* are examples showing a structural framework of a device for evaluating the resilience force of a film member against elastic deformation.

FIG. 17*a* is a structural example of a device for evaluating the restoring force of the film member against elastic deformation. This can evaluate the resilience after hysteresis such as heat that was applied to the sample film, and thereby determining whether the resilience against elastic deformation is easily deteriorated or not.

As shown in FIG. 17*a*, only one end of a sample film 75 is fixed to a Z-axis stage 82. A contact member 83 for deforming the sample film 75 is placed on an electronic scale 84, and the contact member 83 contacts the free end of the sample film 75 to deform the sample film without touching a board 81.

When deforming the sample film, a micrometer 85 can measure how much the Z-axis stage 82 is driven in. A load applied to the contact member 83 upon pushing can be measured by the electronic scale. This device can find a relationship between the drive amount and the force.

Figure 17B:
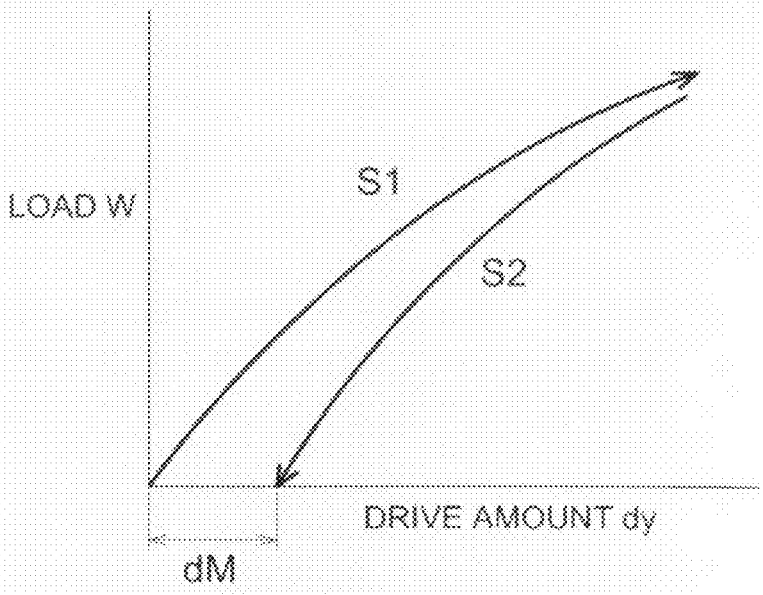

FIG. 17*b* shows an example of a relationship between a drive amount dy (horizontal axis) and a load W applied to the sample film 75 (vertical axis). A change in the resilience against elastic deformation can be evaluated by comparing elastic deformation as being pushed (curved line S1) and restoration as being released after hysteresis such as heat was applied (curved line S2). A member which is easier to lose its resilience shows a greater dM, which is the difference between the drive amount dy before driven-in (curve S1) and the drive amount dy after restored (curve S2)).

<Evaluation Results of Examples 12 to 15>

Evaluation results of Examples 12 to 15 are shown in Table 4.

TABLE 4

| | Sample symbol | 40° C. storage time | Development hysteresis | Toner layer potential |
|---|---|---|---|---|
| Example 12 | A | 12 h | B | B |
| Example 13 | C | 12 h | B | B |
| Example 14 | A + PET | 12 h | A | A |
| Example 15 | C + PET | 12 h | A | A |

In the chart, "development hysteresis" shows the evaluation results of ghost-image occurrence based on the above criteria, and the evaluations were performed on the 100th print.

"Toner layer potential" shows the evaluation results of the measurement of a surface potential of the toner-collecting developer supporting member between the N4 and N6 poles based on the above criteria, and these were also evaluated on the 100th print.

Table 4 indicates that all Examples 12 to 15 of the present invention maintained good image output (B) or higher in the continuous printing of 100 sheets after being kept at 40° C. for 12 hours. In particular, Examples 14 and 15 maintained excellent image output (A).

In Examples 12 and 13, when the contact condition between the film member and the surface of the toner-collecting developer supporting member after high temperature storage was checked, a slight attachment of toner onto the film surface was found.

It is believed that the contact pressure was reduced by a creep phenomenon caused by the high temperature, and thus, scraping of the attached toner by the magnetic brush was suppressed.

In other words, when the film member has a laminated structure of the first film member having conductivity and the second film member which is creep-resistant, i.e., its resilience against elastic deformation is less deteriorative than the first film member, the film member reliably maintains its contact pressure even under high-temperature, and consequently, toner accumulation is controlled and good images can be reliably obtained.

Examples 16 to 17

Prepared are an image forming apparatus with the same developing device as Example 1, and an image forming apparatus of the same type with a magnetic member 43 additionally provided in the developing device, for stabilizing the abutting pressure of the toner separation member 41. As the magnetic member for abutting the toner separation member 41 by magnetic attractive force, magnetic particles were fixed to the film member as shown in FIG. 15*a*. Carrier particles were used as the magnetic particles.

Using the above two kinds of image forming apparatuses, the image chart shown in FIG. 2*a* was continuously printed on 1000 sheets, and the occurrence of development hysteresis (ghost) was evaluated at certain numbers of prints using the same evaluation method as in Example 1. In addition, the apparatuses were evaluated after being kept in a high-temperature high-humidity environment (50° C. and 80% RH) for one week. In other words, the same evaluation results as in Example 1 can be expected for the evaluation results of the image forming apparatus with the same developing device as Example 1 in the above continuous printing of 1000 pages, before it was kept in a high-temperature high-humidity environment (50° C. and 80% RH) for one week.

Example 16

Example 16 used the same image forming apparatus as in Example 1.

Example 17

Example 17 used the same image forming apparatus as in Example 1 with the magnetic member 43 additionally provided in the developing device, for stabilizing the abutting pressure of the toner separation member 41.

(Evaluation Results)

Evaluation results of Examples 16 and 17 are shown in Table 5.

TABLE 5

| | Toner separation member (film member) | Number of prints | Before high-temperature high-humidity storage: Development hysteresis | Before high-temperature high-humidity storage: Toner layer potential | After high-temperature high-humidity storage: Development hysteresis | After high-temperature high-humidity storage: Toner layer potential |
|---|---|---|---|---|---|---|
| Examp. 16 | With magnetic member | 1 | A | A | A | A |
| | | 10 | A | A | A | A |
| | | 100 | A | A | A | a |
| | | 1000 | A | A | A | A |
| Examp. 17 | Without magnetic member | 1 | A | A | A | A |
| | | 10 | A | A | A | B |
| | | 100 | A | A | B | C |
| | | 1000 | A | A | C | C |

In Table 5, "with magnetic member" and "without magnetic member" of Examples 16 and 17 indicate whether a magnetic member is provided on the back of the film member or not as the above-described toner separation member, respectively. As shown in Table 5, both Examples 16 and 17 had good results relating to the effect of the toner separation member (film member) in the evaluations before the high-temperature high-humidity storage. However, in the evaluations after the high-temperature high-humidity storage, Examples 16 and 17 exhibited different results with regard to the effect of the toner separation member depending on the presence or absence of the magnetic member.

Each toner separation member (film member) was removed after the high-temperature high-humidity storage evaluation, and it was confirmed that each film member was deformed in a bent shape by creep, and that toner had attached to the surface of the film member abutting to the developer in Example 17 which did not have the magnetic member.

The above results indicate that, the abutting pressure of the toner separation member (film member) was maintained by providing the magnetic member even when the film member was deformed by creep. In other words, in addition to the effect of the toner separation member of the present invention in the developing device, if abutting of the toner separation member is secured by magnetic attractive force in the developing device, further effects can be obtained such that the device can be maintained with almost no toner attached to the toner-collecting developer supporting member even when the film member is deformed by creep in a high-temperature high-humidity environment. Thus, resetting of post-development residual toner on the toner supporting member is stabilized, and consequently, the device can output good stable images.

As described above, in the developing device and the image forming apparatus of the present embodiment, the toner separation member is provided which abuts the toner-collecting developer supporting member through the toner-collecting developer layer at the downstream of the toner collection area, and a bias voltage is applied to the toner separation member to form an electric field in such a direction as to pull the toner away from the toner-collecting developer supporting member.

This arrangement realizes a stable collection of toner from the toner supporting member to the toner-collecting developer supporting member, even when the toner is unevenly distributed on and attached to the surface of the toner-collecting developer supporting member in the toner collection area between the toner supporting member and the toner-collecting developer supporting member.

Therefore, resetting of the post-development residual toner on the toner supporting member is reliably maintained and good stable images without the effect of development hysteresis are formed.

In other words, the toner-collecting developer supporting member collects almost entirely the post-development residual toner on the toner supporting member, and a stable toner layer is supplied on the toner supporting member. Because of this, toner collecting ability is maintained and high-quality images without a ghost problem are formed for a long period of time.

The above embodiment is an example in all respects and not meant to be limited in any way. The scope of the present invention is not indicated by the above description, but in the claims, and any content equivalent to the claims and any change within the scope of the claims are included herein.

What is claimed is:

1. A developing device, comprising:

a developer container for containing developer including toner and carrier;

a toner-supplying developer supporting member for supporting on a surface thereof the developer in the developer container to convey the developer;

a toner supporting member for supporting toner received from the toner-supplying developer supporting member and conveying the toner to develop an electrostatic latent image on an image supporting member;

a toner-collecting developer supporting member for being supplied with the developer from the toner-supplying developer supporting member and collecting a post-development residual toner from the toner supporting member into the developer;

a toner separation member which is configured to contact with the toner-collecting developer supporting member through the developer on the toner-collecting developer supporting member; and a power supply for applying a bias voltage to the toner separation member, wherein the power supply forms an electric field between the toner separation member and the toner-collecting developer supporting member in such a direction as to pull away toner in the developer on the toner-collecting developer supporting member from the toner-collecting developer supporting member.

2. The developing device of claim 1, wherein the toner separation member includes a film member.

3. The developing device of claim 1, wherein the electric field is a vibrating electric field.

4. The developing device of claim 1, wherein the toner separation member has a surface which is in contact with the toner-collecting developer supporting member and has the same triboelectric charging polarity as the toner with respect to the carrier.

5. The developing device of claim 1, wherein the toner separation member has conductivity and has a laminated construction of a first film member and a second film member, wherein the first film member contacts with the toner-collecting developer supporting member, and a second film member has a less deteriorative resilience against elastic deformation than the first film member.

6. An image forming apparatus, comprising:

an image supporting member for supporting an electrostatic latent image thereon; and a developing device for developing the electrostatic latent image with toner, the developing device comprising:

a developer container for containing developer including toner and carrier;

a toner-supplying developer supporting member for supporting on a surface thereof the developer in the developer container to convey the developer;

a toner supporting member for supporting toner received from the toner-supplying developer supporting member and conveying the toner to develop an electrostatic latent image on an image supporting member;

a toner-collecting developer supporting member for being supplied with the developer from the toner-supplying developer supporting member and collecting a post-development residual toner from the toner supporting member into the developer;

a toner separation member which is configured to contact with the toner-collecting developer supporting member through the developer on the toner-collecting developer supporting member; and a power supply for applying a bias voltage to the toner separation member, wherein the power supply forms an electric field between the toner separation member and the toner-collecting developer supporting member in such a direction as to pull away toner in the developer on the toner-collecting developer supporting member from the toner-collecting developer supporting member.

7. The developing device of claim 1, wherein the toner separation member is urged to contact with the toner-collecting developer supporting member by a magnetic attraction force of a magnetic pole provided in the toner-collecting developer supporting member.

8. The developing device of claim 7, wherein the toner separation member includes a film member.

9. The developing device of claim 8, wherein the toner separation member includes a magnetic member on a back side of the film member.

10. The developing device of claim 9, wherein the magnetic member is a discontinuous body.

11. The developing device of claim 9, wherein the magnetic member is flexible.

12. The developing device of claim 8, wherein the film member includes dispersed magnetic material particles.

13. The developing device of claim 7, wherein the toner separation member is disposed at a position facing the magnetic pole provided in the toner-collecting developer supporting member.

14. An image forming apparatus, comprising:

an image supporting member for supporting an electrostatic latent image thereon; and a developing device for developing the electrostatic latent image with toner, the developing device comprising:

a developer container for containing developer including toner and carrier;

a toner-supplying developer supporting member for supporting on a surface thereof the developer in the developer container to convey the developer;

a toner supporting member for supporting toner received from the toner-supplying developer supporting member and conveying the toner to develop an electrostatic latent image on an image supporting member;

a toner-collecting developer supporting member for being supplied with the developer from the toner-supplying developer supporting member and collecting a post-development residual toner from the toner supporting member into the developer;

a toner separation member which is configured to contact with the toner-collecting developer supporting member through the developer on the toner-collecting developer supporting member by a magnetic attraction force of a magnetic pole provided in the toner-collecting developer supporting member; and a power supply for applying a bias voltage to the toner separation member, wherein the power supply forms an electric field between the toner separation member and the toner-collecting developer supporting member in such a direction as to pull away toner in the developer on the toner-collecting developer supporting member from the toner-collecting developer supporting member.

* * * * *